US006267737B1

(12) United States Patent
Meilus

(10) Patent No.: US 6,267,737 B1
(45) Date of Patent: Jul. 31, 2001

(54) ROBOTIC SYSTEM FOR LENGTHENING MUSCLES AND METHOD OF USE

(76) Inventor: Algis A. Meilus, 331 N. Tessier Dr., St. Petersburg Beach, FL (US) 33706

( * ) Notice: Subject to any disclaimer, the term of this patent is extended or adjusted under 35 U.S.C. 154(b) by 0 days.

(21) Appl. No.: 08/858,530

(22) Filed: May 15, 1997

(51) Int. Cl.[7] ..... A61H 7/00

(52) U.S. Cl. ..... 601/108; 601/134; 606/204

(58) Field of Search ..... 600/553, 557; 606/204, 205.15, 240, 201, 237–245; 601/84, 97, 98, 107, 108, 110, 111, 115, 116, 117, 134, 135, 133, 23, 24, 26

(56) References Cited

U.S. PATENT DOCUMENTS

| | | | | |
|---|---|---|---|---|
| 2,422,520 | * | 6/1947 | Bartley | 600/557 |
| 4,041,938 | * | 8/1977 | Wintoniw | 601/101 |
| 4,243,025 | * | 1/1981 | Jones | 606/242 |
| 4,662,363 | * | 5/1987 | Romano et al. | 601/134 |
| 4,686,968 | * | 8/1987 | Scherger | 606/237 |
| 5,083,552 | * | 1/1992 | Lipowitz | 601/84 |
| 5,301,683 | * | 4/1994 | Durkan | 600/557 |
| 5,456,656 | * | 10/1995 | Skovira | 601/84 |
| 5,458,118 | * | 10/1995 | Monsivais | 600/557 |
| 5,545,177 | * | 8/1996 | Coseo | 606/204 |
| 5,569,166 | * | 10/1996 | Stone | 601/39 |
| 5,592,947 | * | 1/1997 | Lavigne et al. | 600/557 |

* cited by examiner

*Primary Examiner*—Danton D. DeMille

(57) ABSTRACT

A robotic muscular therapy system, and method of use, for applying repeated amounts of concentrated pressure to targeted muscles one-at-a-time to lengthen even deeply positioned muscle tissue layer by layer and thereby reduce limitations on joint extension and flexibility as well as eliminate pain caused by excess muscle contraction. The system comprises a beveled treatment probe designed to concentrate pressure without breaking the skin of an average patient, a probe column assembly for fine X, Y, and Z probe movement over a patient, and a plurality of interchangeable column assembly supports for coarse X, Y, and Z probe movement. Patient safety limitations include a torque-limited and current-limited motor with a slip clutch, a probe which withdraws from its treatment position when a patient grabs it or a pre-set maximum tissue pressure is encountered, and a swivel fitting which allows the probe to give when a patient sneezes and allows patients to easily push the probe away upon demand. The system may optionally have an X-Y positionable patient support; automated control means probe movement; a computer learn mode for creating individualized treatment routines; patient movement sensors; and probe sensors for patient progress data collection. Applications can include, but are not limited to, elimination of acute and chronic of pain; treatment of conditions resulting from accidents and injury; pre-surgery conditions involving muscle spasm; post-surgery recovery, reduction of scar tissue, and restoration of flexibility; reduction of stress and tension; improved sports performance; treatment of conditions involving restricted physical movement; and postural improvement.

20 Claims, 7 Drawing Sheets

ROBOTIC SYSTEM FOR LENGTHENING MUSCLES AND METHOD OF USE

BACKGROUND—FIELD OF INVENTION

This invention relates to robotic devices, specifically to a robotic system that is used to apply repeated amounts of concentrated pressure to targeted muscles in a patient's body for periods up to approximately ten minutes per treatment site. During a period of treatment muscle tissue near the skin surface is first affected, then layer by layer as the tissue above it softens and lengthens, deeper layers of tissue within the same muscle as well as separate layers of muscle more deeply positioned thereunder are successively affected for the purpose of lengthening even the most deeply positioned layer which may not be readily accessible by other procedures such as massage therapy to allow greater extension and flexibility in joints influenced by the treated muscles, as well as elimination of pain resulting from excess muscle contraction due to such causes as disease, stress, overuse, or injury. Applications can include, but are not limited to, elimination of acute and chronic of pain; treatment of conditions resulting from accidents and other injuries; pre-surgery conditions involving muscle spasm; reduction of stress and tension; improved sports performance; treatment of conditions involving restricted physical movement; postural improvement and correction; and post-surgery recovery, reduction of scar tissue, and restoration of flexibility.

BACKGROUND—DESCRIPTION OF PRIOR ART

Many people experience musculoskeletal pain, the source of which can be related to sports activities, other strenuous physical activity, accidents, poor posture, medical conditions, and other causes. Such pain is routinely treated by a variety of procedures that include the use of anti-inflammatory drugs, narcotic medications, thermal devices to raise or lower the temperature of affected tissues, electric stimulation, ultrasound, physical therapy, and muscular massage. However, while use of these treatment procedures can be effective for the temporary relief of adverse symptoms and limited mobility related thereto, such treatments are not usually effective in relieving the cause of the symptoms. Also, the drugs and medications can induce adverse side affects in patients.

As a result, the Department of Energy through Technology Development Cooperatives and Technology Transfer Initiatives has recently sponsored research into new therapy approaches to physical medicine that includes the emerging field of muscular therapy developed by the inventor herein which takes an engineering approach to treating the body by viewing it as a series of cables and filicrums. When a repeated activity is conducted to the extent that it causes excess muscle contraction in a muscle or in a group of muscles layered upon one another, pain or discomfort to one or more regions of the body can result. For example, overuse of the biceps causes a change in the fulcrum for lower arm movement. Attempts to work the triceps hard against a shortened biceps will create pain. Reduction in the amount of excess muscle contraction and resulting reduction in the pain and limited mobility caused thereby is then provided through the use of physics and the repetitive application of concentrated pressure layer by layer to targeted muscles in the region. During muscular therapy treatments, concentrated pressure is applied for extended periods of time not to exceed approximately ten minutes first to affect muscles near the skin surface and then layer by layer during the period of treatment to successively affect more remote portions of the muscle as well as separate muscles more deeply positioned thereunder to eventually lengthen layer upon layer of targeted muscle tissue so that joints influenced by the treated muscles are able to move with less restriction. Relief provided by muscular therapy is often immediate, allowing the quick resumption of activity. Preventative self-treatment with muscular therapy procedures can prevent problems from recurring. Also, with continued muscular therapy muscles have a faster recovery following exercise, greater stamina, more leverage, and increased power and accuracy. Further, it has been demonstrated that people with a skewed center of gravity, both disease related and that due to poor posture, can achieve better balance through muscular therapy. Also, through muscular therapy, athletes have been shown to achieve improved sports performance. In addition, repetitive application of pressure to injured tissue, besides relieving pain and enhancing blood circulation therein, desensitizes it and helps to speed the maturation of scars.

Although not yet widely used, muscular therapy is a developing alternative to the above-mentioned treatment procedures used for relieving musculoskeletal pain, as well as the pain and loss of range of motion associated with myofascial pain syndrome and other soft tissue injures, which if left untreated could lead to disability. Prior to the development and use of the present invention, muscular therapy treatments were performed by the inventor herein manually with his fingers, hands, and elbows, as well as through the use of various hand-held tools. The inventor herein tried tools with treatment ends having a variety of shapes and widths. He found that that tools with broad treatment ends, round ends, and even treatment ends having a flat configuration with a width dimension less than one-half inch, tended to distribute forces instead of concentrate them. The treatment ends of such tools also allowed tendon slippage and were otherwise generally ineffective in applying the type of concentrated pressure needed to optimally lengthen deeply positioned layers of muscle and achieve the increased mobility and pain relief sought by patients. The inventor herein achieved the best manual muscular therapy results through the use of a T-shaped hand-held tool with a beveled treatment edge that could be positioned against targeted muscles at various angles. However, even with such a tool, the amount of force and the angles which were required for successful patient treatment were not easily achievable without injury to the therapist. Further, the inventor herein found that manually performed muscular therapy was physically demanding since in performing certain treatment procedures, such as when he tried to loosen back muscles, he was required to apply one hundred pounds of pressure or more with the tool to reach the most deeply positioned layers of muscle at a treatment site. Consequently, as a work day progressed he would tire, and unless he limited the amount of time he devoted to tissue manipulation his treatments would become non-uniform. For the purpose of overcoming the above-stated disadvantages of manual muscular therapy, as well as to provide a capability for application of pressure with greater frequency and precision, the present robotic invention was developed. Since the application of one hundred pounds of pressure or more is required to lengthen some muscle tissue, features for patient safety were also incorporated into the structural design of the present invention.

Unlike massage therapy which treats the muscle itself superficially, or physical therapy which works to strengthen weak spots, muscular therapy involves the repeated application of concentrated pressure to individually targeted muscles one-at-a-time over an extended period not to exceed approximately ten minutes per treatment site. It first softens and lengthens muscle tissue near to the skin surface and during the treatment period successively affects layers of muscle tissue more deeply positioned thereunder to release from them the build-up of lactic acid and other metabolic by-products resulting from extended duration contraction, such as that occurring as a result of strenuous exercise and spasm. As pressure is applied gradually to a specific point of spasm within a muscle to treat it, the point of spasm sometimes being as small as the size of a small pea, three changes occur. First the muscle tissue lengthens, which is observable under a microscope. Upon such lengthening of muscle, normal blood flow is restored to a muscle, pain and tension is diminished, and the muscle is freed for peak performance. Second, electrical activity is reduced in the nerves that enervate the muscles in the treated area, a change which is measurable by EMG units, such as those typically used for biofeedback. Third, three acids are released, lactic acid, carbonic acid, and hyaluronic acid which result in the sting and discomfort felt by the patient during the application of the pressure. As the muscular therapy process continues, the muscle tissues soften and lengthen, the discomfort diminishes, and when all of the acid is ultimately removed from the muscle, one hundred pounds or more of pressure can usually be applied to the muscle with no discomfort even though the patient remains aware of the pressure.

The present invention, with a robotic arm and a beveled probe attached thereto configured to optimally concentrate applied forces without breaking the patient's skin, is designed to duplicate the movements and amounts of pressure applied manually by therapists. It does not tire during a day's work, and can consistently apply uniform pressures. Therapist injury is also avoided. The present invention can also apply pressure with greater frequency, apply initial pressure with greater precision, apply repetitive pressure at the same location with greater precision, and deliver different modes of pressure application than are possible through manual treatment. Thus the present invention allows application of uniform pressures to a patient's muscles for consistent and effective lengthening thereof, as well as reduction of pain, increased range of motion of both the treated muscles and muscles interacting therewith, and less dependency by athletes and others on anti-inflammatory and narcotic medications.

The present invention discloses several means for placing its probe column assembly into a proper position relative to a targeted treatment area on a patient through the use of frame-within-a-frame assemblies, including a portable overhead sliding probe column support assembly, a gantry-style assembly, a cantilevered assembly, and a cartesian assembly which provides a stationary probe column support in combination with an X-Y positioning table for support of a prone or supine patient which can move in X-axis and Y-axis directions to bring the targeted probe working area on the patient to its treatment probe during automated treatment routines, with the X-axis direction being from the head of a patient to the patient's feet, the Y-axis direction being from the left side of a patient to the patient's right side, and the Z-axis direction representing vertical movement relative to the ground. The scope of the present invention also includes an embodiment similar to the cantilevered assembly structure, but instead of having one end of its inner frame connected to the external frame and the probe column assembly moving relative to only one side of the external frame, the inner frame is centered within the external frame for movement of the probe column assembly relative to the central part of the external frame back and forth in the X-axis direction. Essentially such an embodiment entails the use of a structure similar to the portable overhead sliding probe column support assembly to support the X-Y positioning system of the cantilevered embodiment and produce an automated system whereby the X-Y positioning system is centered within the external frame rather than protruding in a cantilever position from the external frame. The gantry-style support assembly frame structure is essentially a box within a box. Since the cantilevered assembly is heavy, Z-axis movement is accomplished through the use of a crank, in contrast to the lighter overhead sliding probe column support and gantry-style assemblies which can easily be moved by hand and wherein a screw can be used to keep the inner frame in a given position relative to its external frame. The frame-within-a-frame probe column support assemblies in the preferred embodiments of the present invention provide for enhanced patient safety by allowing for stability of the probe column assembly and preventing unexpectedly movement during automated treatment routines. Also, since the probe column support assemblies of the present invention are stable without being bolted to the floor, their structure can be designed to slip and give and rise when a patient unexpectedly moves to further enhance patient safety. By design the entire system is weighted in such a manner that if a patient would sneeze, the system would give and roll away to provide several levels of safety accommodation. The frame-within-a-frame assembly concept can be understood by comparing it to a traditional double-hung window which is cut out of a house to create a box that holds the entire window. The removed portion of the house would become the external frame for the robotic mechanism of the present invention, with the frame structure surrounding the double-hung panes and allowing vertical pane movement providing the internal frame for the robotic mechanism. The inner frame would be spring loaded so that if a robotic mechanism were placed into the position of the window panes it would not unexpectedly come down on a patient during its up and down movement relative to the patient. If wheels would become added to the external frame, coarse X-axis movement of the robotic mechanism could be made from the head to the feet of a prone or supine patient. Vertical movement of the inner frame relative to the external frame would allow Z-axis movement of the robotic mechanism relative to the ground. Also, lateral movement of the robotic mechanism relative to the inner frame would provide Y-axis movement of the robotic mechanism from the left side of a prone patient to the patient's right side.

Safety features built into the present invention due to the fact that one hundred pounds of pressure or more are potentially applied to a patient, include a small easily-controlled probe working area which the computer recognizes in the form of an approximately twelve inch square and six inch high grid pattern for precise X, Y, Z targeting of muscle treatment, with X-axis movement representing movement from the head to the feet of a patient, Y-axis movement representing movement from the left side of a prone patient to the patient's right side, and Z-axis movement representing vertical movement relative to the ground. Also, the present invention includes a probe column assembly constructed so that its attached treatment probe can move within the probe working area in precise fractional increments in the Z-axis direction toward and away from the patient, and also in the X-axis and Y-axis directions as well. As a result its treatment probe can slowly approach a patient's body at approximately one-half of an inch per second, and can also advance in precise fractional increments of approximately one-sixteenth of an inch. The probe column assembly is also constructed so that its treatment probe will automatically retract during an automated treatment routine when it encounters tissue pressure exceeding a maximum pre-determined pressure individually adjusted according to patient needs before the start of treatment. Further, the probe column assembly of the present invention has a swivel fitting that permits a substantially 360° arc of movement of the probe within the designated probe working area, at least as close to 360° as is possible within the mechanical limitations of its ball-and-socket type of swivel joint, allows the probe to move through approximately 180° from a raised horizontal position in one direction to a raised horizontal position in the opposite direction, and also permits probe movement away from its typically downwardly depending treatment position by a patient's hand at any time a patient no longer desires to receive treatment. This would allow for patient intervention similar to a manual muscular therapy situation where a therapist would be trying to apply one hundred pounds of force to muscle tissue with his or her knuckles. For example, if a patient were lying on his or her stomach on a treatment table and the patient's shoulder muscles were targeted for treatment, the therapist would place a knuckle straight into the patient's shoulder trying to simulate a beveled treatment edge. In doing so, the therapist's legs would be moved back away from the table with the therapist leaning over the patient with straightened arms and applying a large force to the patient's shoulder. Should the patient then move, due to the unstable position of the therapist, the therapist could be caused to fall and result in the pressure being removed. The swivel fitting and a quick release mechanism of the present invention, in combination, allow probe movement from any direction and the swivel fitting has a friction resistance that can be reduced to zero by the pressing of a lever. The swivel joint and quick release mechanism combination is designed to provide sufficient resistance for application of concentrated pressures to effect therapy, but also to provide sufficient give that a patient moving or pushing the probe column assembly by hand can break the resistance and move the probe column assembly out of the treatment position in the event of panic or power failure. The swivel fitting also allows for the application of concentrated pressure at a variety of angles, as well as allowing for slippage that avoids patient injury when the patient coughs or sneezes, or undergoes side-to-side movement for any other reason. The swivel fitting is similar to a ball-and-socket type of joint with a spring to provide friction. Pressing on the aforementioned pivoted lever releases the spring to allow free movement of the swivel assembly and adjustment of the treatment probe position relative to the patient. A side screw allows tension adjustment in the spring.

Additional safety features enhancing patient safety include selection of a motor with limited torque to advance the treatment probe, by choosing one with sufficient torque to effectively handle the work assigned to it without excess. The maximum motor force of the present invention is further limited by a slip clutch and a limitation on the amount of electrical current made available to the motor. The slip clutch works similar to an automobile clutch. Another way in which to understand the operating mechanism of the slip clutch plates is to think of a person placing their hands together with fingers extended, typical of a prayer position. Mere placement of the hands together causes a certain amount of tension between them, but they easily slip against one another during rotation of one hand relative to the other out of the prayer position. When the hands are pushed harder together in the prayer position, the palms can still be made to slip relative to one another as one hand is caused to rotate out of the prayer position, however, the change is more difficult to effect. It does not matter how hard the hands are pressed together, the palms will always slip relative to one another when rotational forces are applied to one of them. Without the slip clutch and selection of a motor with limited torque, failure of the motor during an automated treatment routine due to a short circuit in one of its windings might otherwise allow the motor to suddenly be able to deliver ten times more force than the maximum force appropriate for application to the patient. In the alternative, protection against electrical current surges to the motor unexpectedly delivering excessive force to a patient is provided in part by selecting a motor of limited torque, but can also be accommodated through the controlling computer as well as external devices independent from the computer. Complications resulting from failure of electrical current to reach the motor during an automated treatment routine, as well as those which might otherwise occur due to gross movement of a patient upward or to the left or right, are averted by features which cause the probe to automatically and instantaneously retract from the patient into an out-of-the-way position, including motion detection equipment having a switch closure provided by a pressure cell, an infrared detector, or even a simple mechanical contact switch positioned under, along the side of, or on top of the patient and supported by the present invention frame or on the probe. Switch closures applied on the end of the probe are contemplated for use in determining that a patient has pushed the treatment probe out of its usable position during an automated treatment routine and to provide a signal to the controlling computer that the automated routine should be immediately stopped.

The present invention also has a learn mode so that treatment procedures developed for a particular patient can be repeated. In the learn mode a targeted area of the patient's body needing treatment is defined for the computer wherein checkerboard coordinate information is given to the computer with each square in the checkerboard being assigned a number and a position so that the same position can later be found by the probe. The procedure has the same effect as the procedures used in automated assembly lines to define an exact position for the robotic positioning of a screw into a car frame. The present invention also incorporates traditional database software to analyze tissue by plotting tissue variables that identify the state of a patient's muscle tissue, comparing present data to that gathered during previous treatment routines in regularly scheduled week to week therapy, providing statistical information on muscle tissue each week, and displaying average ranges. To provide the data for such analysis, the present invention uses sensors that monitor patient progress by measuring such parameters as the amount of force applied, the sheer force or side to side slippage encountered due to the hardness of the muscle, the amount of electrical current used which is a direct correlation to the force applied, and the amount of electrical activity in EMG units found in the muscle.

Computer controlled massage devices are known which can generate individualized programs for massage therapy to a selected portion of a patient's body, however, they can be distinguished from the present invention. One such device is disclosed in U.S. Pat. No. 5,083,552 to Lipowitz (1992). The Lipowitz invention moves a massage applicator in X, Y, and Z directions, can detect the perimeter of a patient, and has a manual override for individualized massage routines. However, the present invention is different from the Lipowitz invention in that the Lipowitz invention has a four inch wide applicator which distributes pressure over a wide muscular area instead of applying concentrated pressure at a precise treatment site. Thus the Lipowitz invention is not configured to incrementally lengthen layer upon layer of muscle to rid deeply positioned muscles of excess contraction. Further, the Lipowitz invention has no swivel joint safety feature, however, such a safety feature would not be expected to be taught by the Lipowitz invention since only light distributed treatment forces suitable for massage therapy are contemplated and used by the Lipowitz device. Further, motor force in the Lipowitz invention is not limited by a slip clutch, nor are precautionary measures taken against motor failure other than limitation of the size of the Lipowitz motor to one that is practical for the use. With the high levels of force potentially applicable to patients treated by the present invention, additional safety considerations not taught by the Lipowitz invention are important to the present invention. The direct gear construction of the Lipowitz invention would not move out of the way for a patient to stop treatment and get off of the table in the event of patient panic or equipment failure. Also, the Lipowitz invention would not otherwise be readily moveable if the patient had a seizure or heart attack, as would be possible with the swivel joint design give of the present invention. Further, there is no provision taught in the Lipowitz disclosure for outside limitation of electrical current provided to the Lipowitz motor, either through its computer or an external device, and patient safety could be compromised by computer failure or electronic noise impacting signals to the computer if the Lipowitz invention were adapted with a beveled probe in an attempt to perform muscular therapy therewith. Thus the present invention can be seen to have advantages over the Lipowitz invention which are not taught by it and which become important to patient safety when one hundred pounds or more of concentrated pressure is applied to a precise treatment site on the patient.

Treatment devices are also known which apply pressure to a precise point on a patient's body, such as the cervical adjusting unit disclosed in U.S. patent to Jones (1981) which is used in the chiropractic field to correct subluxations of the cervical spine. The Jones invention has a patient support and a force-imparting stylus for applying light force to the side or edge of vertebrae in the neck area of a patient. However, its gearing ratio does not provide the application of powerful forces, as are possible with and required in the present invention for it to perform its contemplated treatment function of lengthening deeply positioned muscle tissue non-palpable by other treatment methods. Also, the Jones invention provides no slippage for patient safety should a patient cough or sneeze during treatment. Further, as the Jones invention is manually operated like a drill press and has no motor, the Jones invention does not teach the use of a slip clutch nor the limitation of electrical current to a motor in a manner that would allow automatic and nearly instantaneous stylus retraction in the event of patient panic or equipment failure, nor does the Jones invention teach a stylus that is readily moveable should a patient have a seizure or heart attack during treatment. Since the combination of known massage therapy and chiropractic devices such as Lipowitz and Jones do not teach a probe capable of safely applying one hundred pounds or more of concentrated pressure to patient muscles to effect lengthening of muscle tissue layer by layer to lengthen even the most deeply positioned muscle tissue, with all of the features of the present invention including a swivel safety joint in combination with a current-limited and torque-limited probe motor, the combination of known massage therapy and chiropractic devices do not teach the present invention. It is not known to have a robotic system configured for performing muscular therapy treatments to muscles to lengthen them which has all of the safety features, patient monitoring capabilities, and other advantages of the present invention.

SUMMARY OF INVENTION—OBJECTS AND ADVANTAGES

It is the primary object of this invention to provide a robotic muscular therapy system which simulates the repeated manual application of concentrated pressures to targeted patient muscles layer by layer to lengthen both surface muscles and remote layers of muscle positioned thereunder during each extended treatment period not exceeding ten minutes at a particular treatment site, and which allows greater frequency, uniformity, and precision than manual pressure applications with increased precision in both initial targeting of a treatment location as well as repetitive application of pressure at the same location. It is a further object of this invention to provide a robotic muscular therapy system which can provide different modes of pressure application. It is also an object of this invention to provide a robotic muscular therapy system with a plurality of interchangeable probe column assembly support structures having different configurations and being made from different materials to vary manufacturing costs and make different embodiments that are serviceable in a greater variety of applications, as well as to make embodiments which are compact, easy to ship, and easy to service with discrete shippable and replaceable components rather than one massive system of components linked with one another. It is a further object of this invention to provide a robotic muscular therapy system having built-in safety features to include a limited probe X, Y, and Z working area, a probe which automatically retracts when it encounters pressure in tissue beyond pre-set maximum levels, a torque-limited and current-limited motor, patient movement sensors, and a swiveled column which allows the probe to move a substantially 360° arc over a patient and through approximately 180° from a raised horizontal position in one direction to a raised horizontal position in the opposite direction so that a patient's hand can move the probe away from its typically downwardly depending treatment position in any direction and at any time a patient no longer desires to receive treatment. A further object of this invention is to provide a robotic muscular therapy system having optional computer control means associated therewith for repeating treatment routines, a learn mode for creating individualized treatment routines for use by patients with special needs, and data gathering capabilities through the use of a variety of sensors to monitor and quantify patient progress from week to week by gathering and compiling data each time a muscle or muscle group is treated. It is also an object of this invention to provide a robotic muscular therapy system having a choice of control means associated therewith, including but not limited to a variety of both computer and manual control means.

As described herein, properly manufactured and used, the present invention would provide a robotic muscular therapy system having a probe with a sharp beveled edge designed to concentrate pressures applied to muscle tissue without breaking a patient's skin, a probe column assembly to provide vertical, or Z-axis movement of a probe downwardly positioned above a treatment area on a patient as well as swivel movement of the probe for optimal treatment of targeted muscles at a variety of angles, and a plurality of interchangeable column assembly supports to include but not be limited to cartesian, cantilevered, gantry-style, and portable overhead sliding supports for coarse X, Y, and Z movement of the probe, with X-axis movement being from the head of-a patient to the patient's feet and Y-axis movement being from the left side of the patient to the patient's right side. In the preferred embodiment the distal treatment edge of the probe would be sufficiently beveled to apply concentrated pressures in excess of one hundred pounds of pressure to a patient's skin for duplication of muscular therapy treatments performed manually by therapists leaning over a patient with a straightened arm and pressing against the patient's skin with knuckles or a beveled T-shaped pressure bar however, treatments with the present invention provide advantages over manual muscular therapy treatments and improved results as to reduction of patient pain and enhanced flexibility, the advantages including not being limited to forces that are initially applied to points of muscle spasm with more precision, forces necessary to lengthen muscle tissue at a point of spasm being applied with greater frequency, repetitive forces applied to the same location being applied with greater precision, and such forces being applied with greater safety to both patient and therapist. Also, the treatment edge would not be sharp enough to penetrate an average patient's skin during the slow incremental advance of the treatment edge toward the patient's skin during the contemplated maximum extended period of muscle lengthening treatment generally not exceeding ten minutes at a particular treatment site. The type of column assembly support chosen by a patient for self-treatment or therapist for use would depend upon several factors, including the maximum space available for placement of the robotic system during its use, the expense of the materials used for manufacture of each column assembly support, and whether the convenience of the features and accessories provided by the more expensive column assembly support embodiments is considered cost effective for the intended use. For example, it is contemplated for the overhead sliding portable column assembly support to have a simple two-part frame-within-a-frame construction. A stable stationary base on its relatively lightweight external frame allows coarse X-axis movement of the probe column assembly through manual movement of the external frame from the patient's head toward the feet of the patient. The probe column assembly of the overhead sliding portable support is releasably attached to a central cross bar in the inner frame and manually moved along the cross bar for coarse Y-axis movement of the treatment probe relative to a patient between treatment sites. Coarse vertical or Z-axis movement of the probe column assembly relative to a patient can be accomplished by manually raising and lowering the cross bar. It is contemplated that fine X, Y, Z probe adjustment would be accomplished through movement of the probe itself. The probe column assembly in the overhead sliding portable support, as well as in all other embodiments, can be connected to a computer for automated treatment routines and controlled as necessary by a variety of control devices such as a computer keyboard, mouse or joystick. A gantry-style embodiment of the column assembly support also provides the same two-part frame-within-a-frame construction for coarse X, Y, and Z movement of the probe column assembly relative to a patient, but would provide such on a wheeled support configured for X-axis movement and limited Y-axis movement along the side perimeter of a patient table, or other patient support. The probe column assembly in the gantry style embodiment would also be releasably attached to a central cross bar for coarse manual Y-axis movement of the probe relative to a patient between treatment, similar to the overhead sliding portable support embodiment. Once coarsely positioned over the designated probe working area and fine X, Y, and Z adjustment being implemented through the probe itself, fully automated probe movement during treatment routines can be provided. Cantilevered and cartesian embodiments also provide a two-part frame-within-a-frame construction for automated and manual coarse X, Y, and Z adjustment of the probe column assembly relative to the designated probe working area over a patient. Like the gantry-styled embodiment, the cantilevered embodiment would have a wheeled column support assembly configured for coarse axis movement along the side perimeter of a table, or other patient support. The probe column assembly of the cantilevered embodiment would downwardly depend from the distal end of a horizontal arm having its proximal end centrally projecting from the upper portion of an upright column assembly support, the horizontal arm being movable with an elongated opening through one side of the column assembly support and capable of moving the probe column assembly in both X and Y directions. A fifth embodiment within the scope of the present invention is nearly identical to the cantilevered embodiment, however its horizontal arm is centrally attached within the upright portion of the upright column assembly support with its probe downwardly suspended through an opening in the bottom surface of the upright column assembly support. Coarse Z-direction movement of the probe column assembly in both such embodiments is provided by a crank which by raising and lowering the upper portion of the column assembly support creates movement of a frame within a frame, with fine Z-axis movement provided by the probe assembly itself. Thus when the probe column assembly is suspended over a patient and downwardly projecting from the horizontal arm in the general area of treatment it can be coarsely or finely moved within the intended probe working area by automated means which are controlled by such devices as a joystick, push button controls, voice-activated control means, infrared-activated control means, or other alternate type of control device such as a computer keyboard. For automated treatment routines, the probe column assembly of the cantilevered embodiment would be initially placed into position relative to the patient once before treatment begins taking into account the patient's stature and the region of the patient's body targeted for treatment. The probe of the cantilevered embodiment would then be moved by automated motorized means within an X-Y treatment area limited to approximately twelve square inches and approximately six inches of Z-direction movement that can be easily controlled by a therapist.

The cartesian embodiment is the most complex of the column assembly support embodiments mentioned above, and therefore would be the most expensive to make and use. It is also contemplated for the cartesian column assembly support embodiment to provide totally automated treatment routines, as is possible with the other embodiments of the present invention, but to have the additional advantage of a fully automated X-Y positioning patient support although such a support is not critical to operation of the cartesian embodiment. Therefore, prior to the start of treatment with the cartesian embodiment having an automated X-Y positioning patient support either the probe can be coarsely moved by automated means in X, Y, and Z directions toward the patient, the patient can be coarsely moved by automated means in X and Y directions toward the probe, or both. For enhanced patient safety, it is contemplated for the base portion of the cartesian probe column assembly support to remain stationary during initial positioning of the probe and during treatment, allowing its telescoping arms to provide coarse X, Y, and Z movement of the probe column assembly relative to a patient prior to the start of a treatment routine. Then, once an automated treatment routine has begun, it is contemplated for the X-Y positioning patient support to move a patient positioned thereon within a limited X-Y work area relative to the treatment probe and the probe's motor to provide limited Z-direction movement. It is further contemplated for computer means associated with the cartesian embodiment to have the same learn mode capability found in other present invention embodiments so that repeatable individualized treatment routines can be established for patients with special needs, with the computer means controlling the movement of the probe column assembly support and the probe, as well as the X-Y positioning patient support. Optionally, it is contemplated for the robotic muscular therapy system of the present invention to also include a plurality of sensors attached to the probe for quantifying a variety of parameters for monitoring and assessment of patient progress, as well as treatment devices such as TENS unit applicators which when connected to the probe administer electrical stimuli to a patient's muscles. Since concentrated pressures of one hundred pounds or more can be applied by the robotic muscular therapy system of the present invention to patient muscles and patient safety is therefore of particular concern, movement of the probe in all column assembly supports including the cartesian embodiment is gear-driven and limited to a Z-direction movement of approximately six inches. Also, movement of the surface of the automated X-Y positioning patient support is limited to a maximum X-Y movement of approximately twelve square inches, which provides a large enough area to cover a patient's lower back, neck, upper leg, lower leg, or any major group of muscles which might require treatment by the probe, yet remains easily controlled by a therapist. Selection of a probe motor having limited torque as well as current limiting means enhances patient safety in the event of equipment failure or a power surge. During automated treatment routines provided by all of the embodiments of the present invention, the probe is first put into position relative to two bony landmarks on the patient once at the beginning of a treatment routine, with the angle of the probe relative to the muscle or muscle group requiring treatment also being set at that time. Thereafter, the automated treatment routine is conducted without further manual positioning of the probe, until the probe must be moved to a new treatment site.

In all embodiments it is contemplated for the probe of the present invention to have a sharp beveled treatment edge designed for concentrating applied pressures exceeding one hundred pounds of pressure against a patient's skin without piercing it, to have swivel joint with a substantially 360° arc of use over the designated probe working area with a capability for probe movement through approximately 180° from a raised horizontal position in one direction to a raised horizontal position in the opposite direction so that a patient can use one hand to push the probe away from its downwardly depending treatment position at any time and from any direction, and to also have a limited Z-axis range of movement. Further, it is contemplated for the probe to be connected to the probe column assembly by means which cause the probe to retract when it encounters pressures in tissue greater than a maximum pressure preset according to needs of each individual patient. All embodiments also have a limited-torque probe motor with a slip clutch and a custom designed board to limit electrical current supplied to the motor for additional patient safety in the event of equipment failure or computer malfunction. A small hobby motor with a slip clutch would accomplish this purpose. The preferred embodiment of the present invention will also comprise sensors for monitoring patient progress, including a force sensor to measure the amount of force being applied to a patient's muscles, as well as a measuring means for sheer force to determine the amount of slip or movement of the probe due to sideways shearing in the muscle. In the preferred embodiment, it is also contemplated for the probe of the present invention to be easily removable from the probe column assembly, or to have removable interchangeable pressure applicators, so that beveled probes of different lengths and widths, as well as pressure applicators having different combinations of sensors attached thereto, can be readily attached for muscular lengthening at different treatment sites. All of the probes and all of the pressure applicators would have a beveled type of configuration to enable simulation of therapist treatments provided manually with beveled edge hand-held T-shaped tools. It is also contemplated for all present invention embodiments to have patient movement monitoring sensors, such as motion detection equipment having a switch closure provided by a pressure cell, an infrared detector, or even a simple mechanical contact switch positioned under, along the side of, or on top of the patient and supported by the present invention frame or on the probe. Switch closures applied on the end of the probe are contemplated for use in determining that a patient has pushed the treatment probe out of its usable position during an automated treatment routine and to provide a signal to the controlling computer that the automated routine should be immediately stopped.

In the preferred embodiment it is contemplated to have means for both manual and automated control of the present invention's probe, including joysticks, push button controls, voice-activated controls, infrared activated controls, and computer means that allow the use of standardized treatment routines, the development of individualized automated treatment routines for patients with special needs, as well as data gathering that provides quantified patient assessment during a series of successive treatment routines. For such data gathering purposes, it is contemplated for the present invention to comprise a plurality of sensors which measure parameters including, but not limited to, the electrical activity in muscle tissue as measured by EMG units, the amount of force applied, and the amount of probe slippage due to sideways shearing in the muscle. An EMG unit requires three contact points, a TENS unit requires two contact points, and the measurement of slippage requires one contact point in combination with a distance measurement of probe movement. Individualized routines for patients with special needs can be created by placing the present invention in a learn mode where the targeted treatment area is divided into grids with each square being assigned a number and a position. A therapist will then manually move the robotic arm and probe through specific treatment areas on the patient to define the patient's body and identify certain treatment protocol, such as quantifying the amount of pressure and duration of its application for each treatment site incorporated into the automated routine. Thereafter, for subsequent treatments on the same patient, the present invention would only require the identification of two bony landmarks on the patient as reference points, the identity of the patient, and the location of the patient relative to the probe, before it could begin the individualized routine created for treatment of the patient. As the patient progresses, additional routines can be easily created for repetitive pressure application until monitoring indicates that a further change in routine is necessary. In the preferred embodiment it is also contemplated for control of the probe to be accomplished through wireless remote control means such as radio frequency controlled devices, voice-activated devices, and infrared-activated devices, as well as through traditional keyboard entry.

The data gathering capabilities of the present invention include the collection of information on the exact amount of tissue contraction in each muscle treated. As a result, after each of several successive muscular therapy treatments, the amount of muscle contraction in a patient can be correlated to the amount of soft tissue injury remaining. Thus the progress of the patient can be plotted to determine whether the current amount of contraction in a particular muscle of the patient is the same, greater, or less than on previous visits to the treatment facility. Should the amount of contraction remain the same or increase, the patient can be checked by a physician for such conditions as nerve entrapment, bone or muscle compression, nerve damage, and torn tissue. It might also be possible in the future for net values associated with tissue contraction of a patient, as determined by the present invention, to be correlated to standardized percentage values assigned by the National Institute of Health, insurance companies, or other similar organizations, to various disabilities so that progress of therapy treatment for individual patients can be plotted for the insurance companies to provide a quantified assessment of the patient's ability to return to work as injured tissues heal. At the present time, a patient's ability to return to work is a subjective assessment, and not a quantitative one. The description herein provides preferred embodiments of the present invention but should not be construed as limiting the scope of the robotic muscular therapy system invention. For example, variations in the configuration and height dimension of the probe column assembly support used, the configuration and height dimension of the patient support used, the type of motors used to move the probe as long as pressure is applied through a torque-limited and current-limited motor for enhanced patient safety, the configuration of the swivel joint connected to the probe column assembly, the length and width dimensions of the beveled probes used, the combinations of sensors attached to the probes, the configuration of the tension control knob used to pre-set maximum applied pressures, the type of contact closure used to determine patient movement, and the dimension and configuration of the probe column assembly housing, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 2:
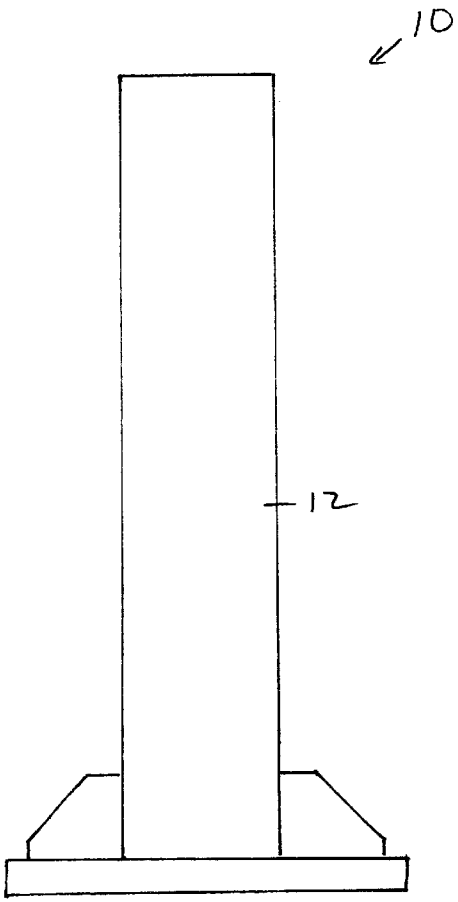
FIG. 2 is a side view of the overhead sliding probe column assembly support of the present invention.

The illustrations of the present invention show four embodiments each having a probe column assembly 14 capable of providing either manual or automated muscular therapy treatment routines in which concentrated pressure is applied to patient muscles layer by layer to lengthen and rid even the most deeply positioned treated muscle tissue of excess muscle contraction. Although not shown, for patient safety purposes it is contemplated for the probe column assemblies 14 to each conduct automated treatment routines within an easily controlled probe working area having dimensions approximately twelve inches square and approximately six inches in vertical height. The difference between the illustrated embodiments is in their probe column assembly supports 12 which are made from different materials and have different configurations so as to provide alternative embodiments which are serviceable in a greater variety of applications, as well as embodiments which can be easily shipped. In spite of their differences in appearance, each probe column assembly support 12 has a two-part frame-within-a-frame construction probe column assemblies 14 for coarse X, Y, Z adjustment of its probe column assembly 14. Also, even though the probe column assemblies 14 of the four illustrated embodiments are shown in essentially identical form, it is within the scope of the present invention for there to be variations in the probe column assemblies 14 used, such as but not limited to variation in its overall configuration and height, the configuration and dimension of its swivel joint 62, the configuration of its quick release mechanism 58, and the number and type of sensor units, such as numbers 94 and 96 shown in FIG. 10, attached to its probe 20.

Figure 1:
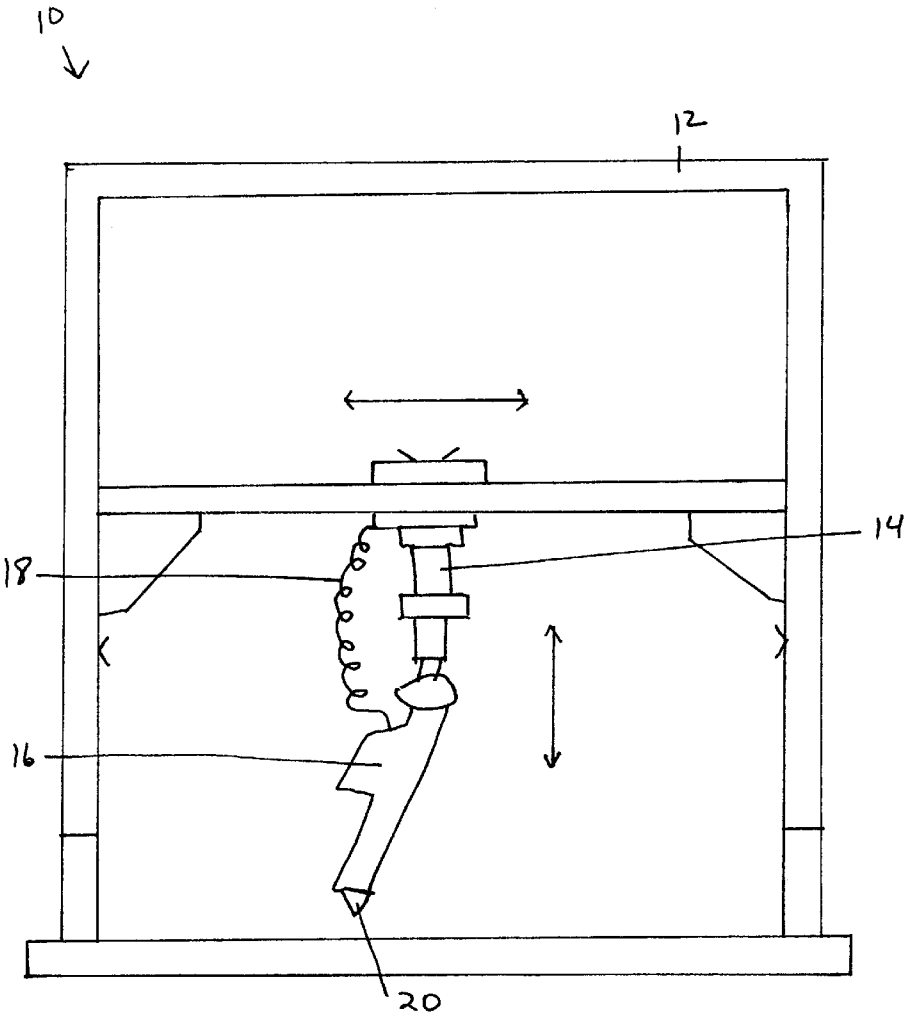
FIG. 1 is a front view of a first embodiment of the present invention having an overhead sliding probe column assembly support, a probe column assembly connected to a central cross bar on the probe column assembly support, and a beveled probe connected to the distal end of the probe column assembly.

FIG. 1 shows a first preferred embodiment of the robotic system 10 of the present invention having an overhead sliding-type of probe column assembly support 12 and a probe column assembly 14 attached to a cross bar 8 centrally positioned on probe column assembly support 12. The embodiment shown in FIG. 1 is the least complex of the four embodiments illustrated herein making it the one that is potentially the lowest in cost and most easily shipped. Although not shown in FIG. 1, it is contemplated for probe column assembly 14 to have the capability of being connected to a computer means, such as the simplistic connection to computer 20 illustrated in FIG. 12, so that the first embodiment of the present invention can be used to learn and conduct automated treatment routines for patients with special needs. It is contemplated for the position of probe column assembly 14 in all embodiments of the present invention to have both coarse and fine adjustment relative to the targeted probe working area on a patient (not shown), with X-axis adjustment taking place from the head of a patient to the patient's feet, with Y-axis adjustment taking place from the left side of the patient to the patient's right side, and vertical Z-axis adjustment taking place relative to the ground. Although not shown in FIG. 1, coarse adjustment of the probe column assembly 14 in the first embodiment of the present invention in the X-axis direction would be through manual movement of probe column assembly support 12 as a whole relative to the patient, coarse adjustment in the Y-axis direction would be through manual movement of probe column assembly 14 back and forth across the length of cross bar 8, and coarse adjustment in the Z-axis direction would be through manual raising and lowering of cross bar 8 relative to the outer perimeter of probe column assembly support 12. It is contemplated for fine X, Y, and Z adjustment of probe 20 relative to a patient to be provided by probe column assembly 14. It is also contemplated for probe column assembly 14 to be releasably attached to cross bar 8 so that the probe column assembly 14 in the first embodiment can attached to other probe column assembly supports 12 of the present invention. It is contemplated for the first embodiment of probe column assembly support 12 to be made of lightweight materials so as to be portable. Also, it is contemplated for probe column assembly support 12 to have a stable front-to-back base configuration so that it will remain in a stationary position during treatment use without tipping over. Further, since probe column assembly support 12 in the first embodiment of robotic system 10 is relatively simple in design, it can be made of inexpensive materials to provide a low cost muscular treatment apparatus for purchase and use by individuals at home or in their work environment. FIG. 1 also shows robotic system 10 having a motor 16 attached to the lower portion of probe column assembly 14, wiring 18 between motor 16 and a remote power source (not shown), and a probe 20 having a sharp beveled edge attached to the distal end of the probe column assembly 14 to enable robotic system 10 to simulate movement and pressure applied during manual muscular therapy treatments. Although not shown in FIG. 1, patient safety is enhanced in the event of motor or computer malfunction through a swivel joint 62 more clearly illustrated in FIGS. 8 and 9, motor 16 being torque-limited and current-limited, and motor 16 having a slip clutch as illustrated by the clutch plates 84 shown in FIG. 11. The slip clutch would work in a manner similar to an automobile clutch. Another way in which to understand the operating mechanism of clutch plates 84 is to think of a person placing their hands together with fingers extended, typical of a prayer position. Mere placement of the hands together causes a certain amount of tension between them, but they easily slip against one another during rotation of one hand relative to the other out of the prayer position. When the hands are pushed harder together in the prayer position, the palms can still be made to slip relative to one another as one hand is caused to rotate out of the prayer position, however, the change is more difficult to effect. It does not matter how hard the hands are pressed together, the palms will always slip relative to one another when rotational forces are applied to one of them. Without clutch plates 84 and selection of a motor 16 with limited torque, failure of motor 16 during an automated treatment routine due to a short circuit in one of its windings might otherwise allow motor 16 to suddenly be able to deliver ten times more force than the maximum force appropriate for application to the patient. In the alternative, protection against electrical current surges to motor 16 causing it to unexpectedly deliver excessive force to a patient is provided in part by selecting a motor of limited torque, such as a hobby motor, but can also be accommodated through the controlling computer 90 as well as external devices independent from the computer (not shown). Complications resulting from failure of electrical current to reach motor 16 during an automated treatment routine, as well as those which might otherwise occur due to gross movement of a patient upward or to the left or right, are averted by features which cause probe 20 to automatically and instantaneously retract from the patient into an out-of-the-way position, including motion detection equipment having a switch closure (not shown) provided by a pressure cell, an infrared detector, or even a simple mechanical contact switch positioned under, along the side of, or on top of the patient and supported by the present invention frame or on the probe. Switch closures applied on the end of probe 20 are contemplated for use in the first embodiment of robotic invention 10, as well as in all other embodiments, for determining that a patient has pushed the treatment probe out of its usable position during an automated treatment routine and to provide a signal to the controlling computer that the automated routine should be immediately stopped.

It is contemplated for the probe 20 in FIG. 1 to be configured, dimensioned, and made from materials which permit it to apply more than one hundred pounds of pressure to patient muscles with out piercing a patient's skin (not shown) during the slow incremental advance of probe 20 toward a patient's skin contemplated during a treatment routine. As shown in greater detail in FIG. 8, it is contemplated for swivel joint 62 to provide a substantially 360° arc of use for probe 20 over a patient (not shown) with probe being able to move from a raised horizontal position in one direction to a raised horizontal position in the opposite direction to allow a patient' hand to move probe 20 away from the treatment area at any time and from any direction during a treatment routine when the patient no longer desires to receive treatment. Swivel joint 62 also allows angular positioning of probe 20 relative individual muscles of a patient for optimal treatment effect. Also, as shown in greater detail in FIG. 8, it is contemplated for probe column assembly support 12 to have a tension control knob 60 for use in setting the maximum pressure that could be applied by probe 20 according to patient needs and beyond which probe 20 will be caused to reverse direction and move away from the patient's body instead of toward it. The overhead sliding-type embodiment of robotic system 10, as shown in FIG. 1, essentially provides a probe column assembly support 12 having a structure comprising a sliding two-part frame-within-a-frame construction with cross bar 8 providing support for probe column assembly 14 and coarse movement of probe column assembly 14 in Y-axis and Z-axis directions while moving within the outer perimeter of probe column assembly support 12, with the outer perimeter of probe column assembly support 12 providing coarse X-axis movement of probe column assembly 14. FIG. 2 shows the side portion of probe column assembly support 12 having a rectangular configuration with a reinforced base for additional front-to-back stability.

Figure 3:
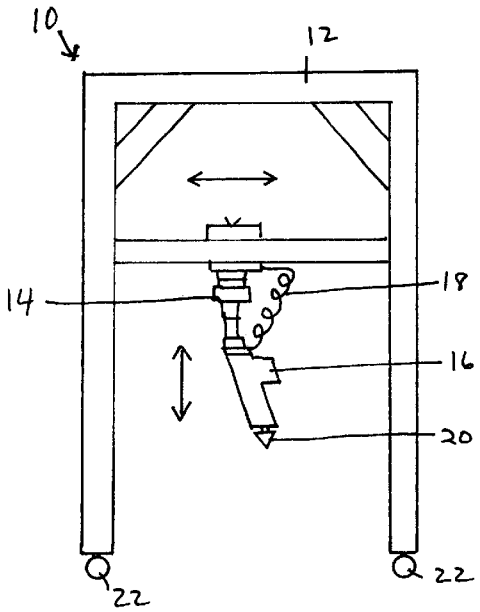
FIG. 3 is a front view of a second embodiment of the present invention having a gantry-type probe column assembly support, a probe column assembly centrally connected to the probe column assembly support, and a beveled probe connected to the distal end of the probe column assembly.

FIG. 3 shows a second preferred embodiment of the robotic system 10 of the present invention with probe column assembly support 12 having a gantry-type of configuration and probe column assembly 14 attached to a cross bar 8 centrally positioned within probe column assembly support 12. The gantry-type embodiment also has a two-part frame-within-a-frame construction similar to that in the first embodiment of robotic system 10, with cross bar 8 providing support for probe column assembly 14 and coarse movement of probe column assembly 14 in the Y-axis direction. Also similar to the Z-axis direction movement in the first embodiment, coarse Z-axis adjustment of probe column assembly 14 in the second embodiment is provided by manual raising and lowering of cross bar 8 within the outer perimeter of probe column assembly support 12. Manual movement of the outer perimeter of the probe column assembly support 12 relative to a patient provides coarse X-axis movement of probe column assembly 14 in the gantry-style second embodiment of the present invention. Fine X, Y, and Z adjustment of probe 20 is achieved through probe column assembly 14. It is contemplated for probe column assembly 14 to be made manually to slide back and forth in both directions along the length of cross bar 8 for coarse Y-axis adjustment of probe column assembly 14 relative to the targeted treatment area on a patient prior to the beginning of an automated muscular therapy treatment routine. Also similar to all embodiments of robotic system 10, it is contemplated for probe column assembly 14 in the second embodiment of robotic system 10 to be releasably attached to cross bar 8. FIG. 3 shows the second embodiment of robotic system 10 further having an open lower end and wheels 22 attached to its lowermost support members so that the gantry-style second preferred embodiment can be moved in the X-axis direction along the perimeter of a patient support table top, such as table top 46 shown in FIG. 7. Since probe column assembly support 12 in the second embodiment of robotic system 10 is also relatively simple in design, it is contemplated that it would be made of lightweight and inexpensive materials to provide a low cost muscular treatment apparatus for purchase and use by both individuals and small clinics.

FIG. 3 also shows the second embodiment of robotic system 10 having motor 16 attached to the lower portion of probe column assembly 14, wiring 18 connected between motor 16 and a remote power source (not shown), and a probe 20 having a sharp beveled treatment edge and being attached to the distal end of probe column assembly 14 with the capability of a substantially 360° arc of movement over a patient and being able to move from a raised horizontal position in one direction to a raised horizontal position in the opposite direction to allow a patient' hand to move probe 20 away from the treatment area at any time and from any direction during a treatment routine when the patient no longer desires to receive treatment. In all preferred embodiments of robotic system 10 it is contemplated for probe column assembly 14 to have all of the features shown in enlarged FIGS. 8 and 11.

Figure 4:
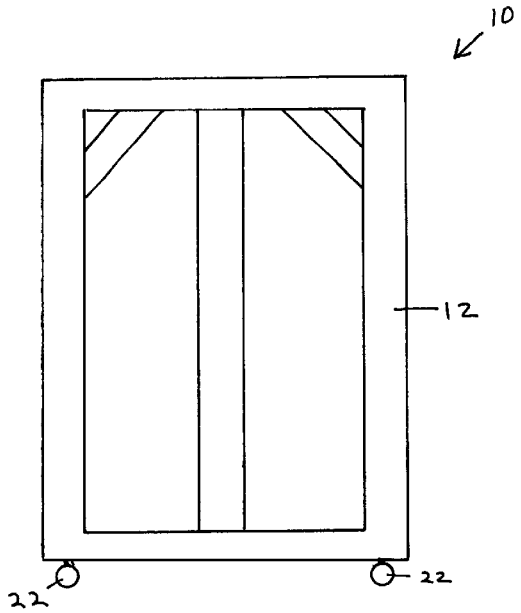
FIG. 4 is a side view of the gantry-type of probe column assembly support of the present invention.

FIG. 4 shows the side structure of the probe column assembly support 12 of the second embodiment of robotic system 10 having an open configuration with a rectangular perimeter and a centrally positioned vertical extension 6 between the top perimeter 4 and the bottom perimeter 2 of probe column assembly support 12. Although not shown, it is contemplated for the opposed side of the second embodiment to have a general configuration identical to that shown in FIG. 4. It is contemplated for cross bar 8 to complete its Z-axis movement through interaction with the two opposed vertical extensions 6. FIG. 4 also shows probe column assembly support 12 having wheels 22 attached under bottom perimeter 2 for ease in coarse X-axis adjustment of probe 20 prior to the start of new muscular therapy treatment routines. A small amount of Y-axis adjustment could also be available through movement of the gantry-style probe column assembly support 12 relative to a table top, such as table top 46 shown in FIG. 7. The dimension and type of wheels 22 used is not critical to the present invention and it is equally contemplated for robotic system 10 to be made mobile by rollers or other types of movable support members.

Figure 5:
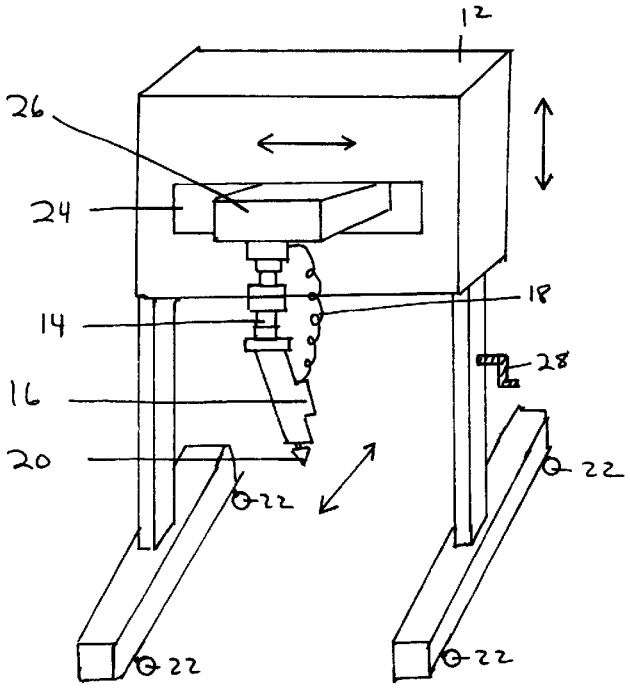
FIG. 5 is a perspective view of a third embodiment of the present invention having a cantilevered probe column assembly support, a probe column assembly centrally connected to the distal end of a horizontal arm projecting from an elongated opening in the upper portion of the probe column assembly support, and a beveled probe connected to the distal end of the probe column assembly.

FIG. 5 shows a third preferred embodiment of robotic system 10 with probe column assembly support 12 having a cantilevered configuration. Although not shown, a similarly configured fifth embodiment of the present invention is contemplated wherein horizontal arm 26 is centrally positioned within probe column assembly support 12 so that probe column assembly 14 extends through an opening in the bottom surface of probe column assembly support 12 for movement within the perimeter of probe column assembly support 12. In FIG. 5, probe column assembly 14 is attached to the distal end of horizontal arm 26 having its proximal end projecting centrally from, and in a position approximately perpendicular to, the upper portion of probe column assembly support 12. The third and fifth embodiments of probe column assembly support 12 are similar to the first and second embodiments in providing a two-part frame-within-a-frame construction for coarse X, Y, and Z adjustment of probe 20 relative to a patient, with horizontal arm 26 providing Y-axis movement and probe column assembly support 12 providing means for both X-axis and Z-axis adjustment. However, due to the extra weight required for support of probe column assembly 14 in a cantilevered position, it is required for the third preferred embodiment to also have automated means for coarse X, Y, and Z probe 20 movement. Such automated probe movement can also be used in the fifth embodiment. Although the needed opening in the bottom of horizontal arm 26 of the third embodiment is not shown, it is contemplated for probe column assembly 14 in the third embodiment to be provided with automated coarse movement in an X-axis direction within such an opening through the bottom surface of horizontal arm 26, as well as in a Y-axis direction through automated coarse movement of horizontal arm 26 within opening 24. In both the third and fifth embodiments, coarse vertical adjustment of probe 20 in the Z-axis direction would be accomplished by use of crank 28 positioned on the lower portion of probe column assembly support 12 which engages a linear rack (not shown) within to the upper portion of probe column assembly support 12 to move a frame-within-a-frame.

As in other embodiments of robotic system 10, fine X, Y, and Z adjustment of probe 20 relative to a patient is provided in the third and fifth preferred embodiments of robotic system by probe column assembly 14, and is also limited to the easily controlled probe working area of approximately six inches of movement in the Z-axis direction and an approximately twelve square inches of movement in X-axis and Y-axis directions. Although not shown in FIG. 5, it is contemplated for automated movement of probe column assembly 14 and horizontal arm 26 of the third embodiment as well as the fifth embodiment to be made in response to commands of either a therapist or the patient undergoing treatment, through use of a variety of manual controls, such as but not limited to, a joystick, remote push button controls, voice-activated controls, infrared-activated controls, and other types of control means including a computer keyboard. FIG. 5 also shows the third embodiment of robotic system 10 having wheels 22 so that it can be moved in the X-axis direction along the perimeter of a patient support table top, such as table top 46 shown in FIG. 7, to coarsely position probe 20 within the probe working area and adjacent to the targeted treatment area. It is contemplated for the fifth embodiment to also have wheels 22. Since the third and fifth preferred embodiments are heavier and more complex to use than the first and second preferred embodiments, it is contemplated for the third and fifth preferred embodiments of robotic system 10 to be purchased mainly for use in clinics. FIG. 5 also shows robotic system 10 having motor 16 attached to the lower portion of probe column assembly 14, wiring 18 connected to between motor 16, and probe 20 having a sharp beveled edge and being attached to the distal end of the probe column assembly 14 for a substantially 360° arc of movement over a patient with the ability to move from a raised horizontal position in one direction to a raised horizontal position in the opposite direction to allow a patient' hand to move probe 20 away from the treatment area at any time and from any direction during a treatment routine when the patient no longer desires to receive treatment. Although not shown, it is also contemplated for the electrical current reaching motor 16 to be limited for patient safety and independent from computer control. The configuration of crank 28 is not critical to the third and fifth preferred embodiments of robotic system 10 and it is also within the contemplation of the present invention to have other control means substituted for crank 28, such as a motor controlled by a button.

Figure 6:
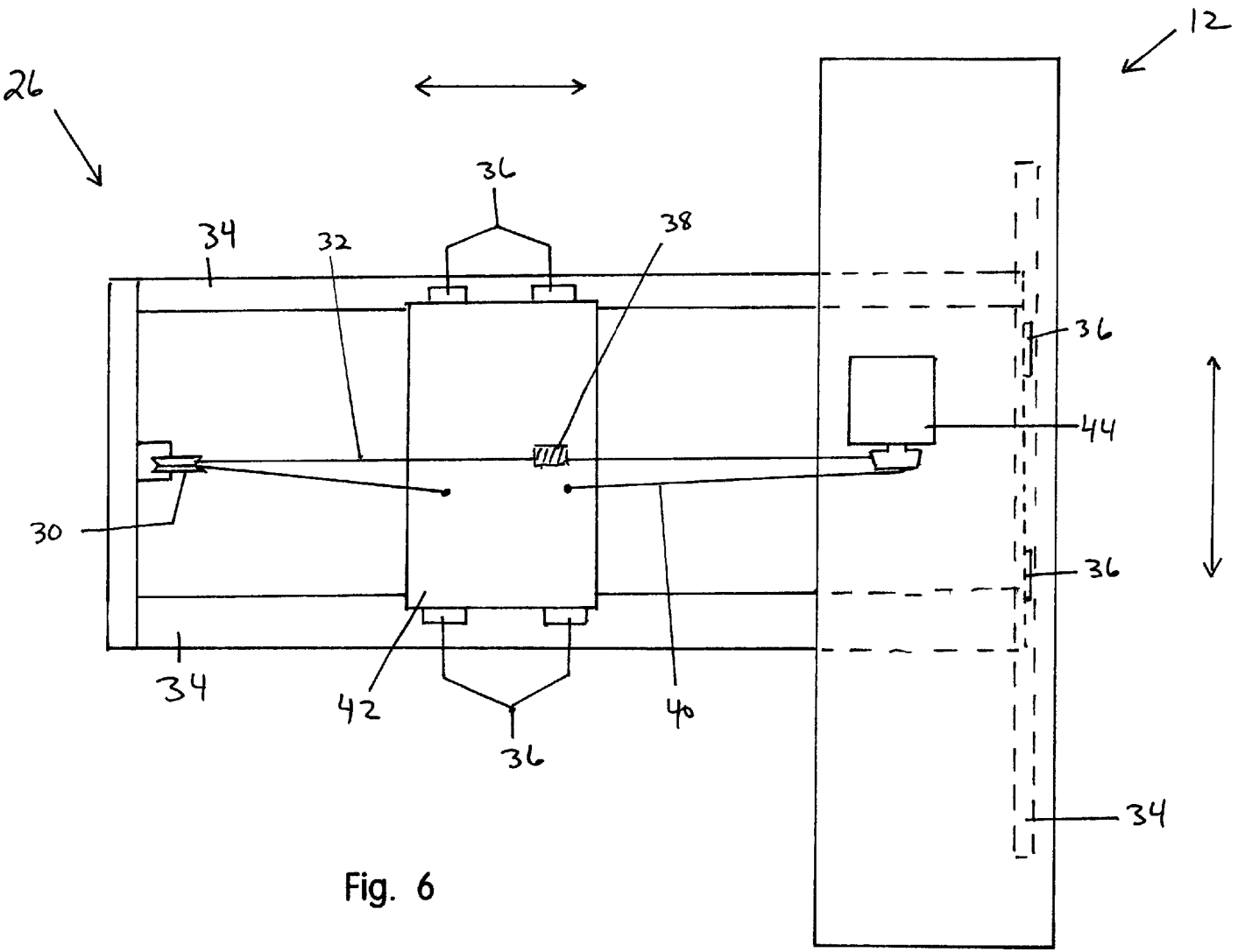
FIG. 6 is a bottom view of the horizontal arm of the cantilevered embodiment having a motor and pulley system, without attachment of the probe column assembly, for use in coarse automated X-direction movement of the probe from a patient's head to the patient's feet.
Figure 7:
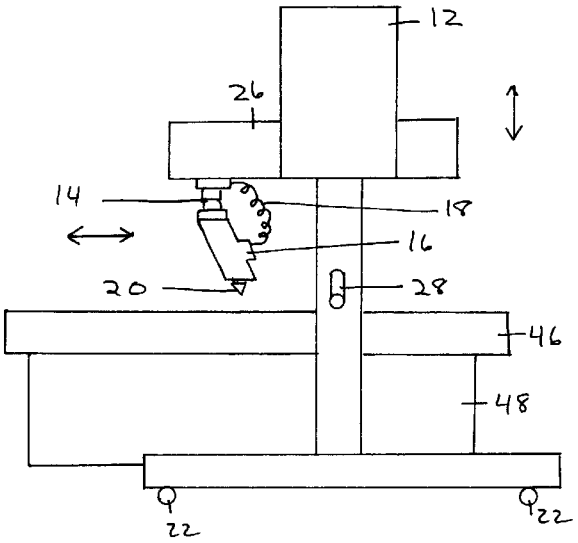
FIG. 7 is a side view of the third embodiment of the present invention positioned adjacent to a patient support.

FIG. 6 shows the third cantilevered embodiment of robotic system 10 having horizontal arm 26 extending through one side of the upper portion of probe column assembly support 12. The proximal end of horizontal arm 26 is shown having rollers 36 positioned within a rear track 34 for lateral movement within opening 24 (shown in FIG. 5) in probe column assembly support 12. Although not shown in FIG. 6, in the third preferred embodiment it is contemplated for horizontal arm 26 to be moved within rear track 34 by a drive system similar to that shown for use within horizontal arm 26 to move inner arm member 42. FIG. 6 shows an inner arm member 42 positioned within horizontal arm 26, a pair of opposed, substantially parallel tracks 34 located along each side perimeter of horizontal arm 26, and rollers 36 attached to each end of inner arm member 42 which are positioned for movement within parallel tracks 34. FIG. 6 also shows a motor 44 housed within probe column assembly support 12 and connected to inner arm member 42 with chain 40. Inner arm member 42 is also connected between the distal end of horizontal arm 26 and motor 44 by a cable 32 connected through a pulley 30 which is centrally attached to the interior portion of the distal end of horizontal arm 26. The other end of cable 32 is connected to chain 40 through a spring means 38. The use of chain 40, cable 32, pulley 30, and spring means 38 is not critical to the present invention, and although not shown, it is also contemplated to have other drive means for movement of inner arm member 42. For example, although not shown another means of moving motor 42 would be to replace cable 32 with a gear track having a length dimension sufficient for the full desired travel distance, with a gear coming from motor 42 pressed against the gear track. As motor 42 would turn the gear attached to it, the gear will move along the track and eliminate the need for cable 32 and pulley 30. In another form of explanation, guiding track 34 would become geared and motor 42 would comprise a gear configured for engagement with the geared surface of guiding track 34. Another replacement for cable 32 and pulley 30, would be the use of a screw (not shown) replacing cable 32 with a gear on motor 42 rotating the screw and another gear attached to assembly 44 which causes assembly 44 to move as motor 42 turns the screw. Thus, probe column assembly 14, shown in FIG. 5 as being attached to inner arm 42, is permitted to move over a patient (not shown) in the X-axis direction as inner arm 42 moves along parallel tracks 34 toward and away from probe column assembly support 12, probe column assembly 14 also moving in a Y-axis direction by movement of horizontal arm 26 relative to the track 34 completely housed within probe column assembly support 12, with horizontal arm 26 reaching track 34 through the opening 24 shown in FIG. 5. As previously stated, coarse Z-axis movement of the probe column assembly 14 in the third preferred embodiment of robotic system 10 relative a patient is accomplished through crank 28, as shown in FIGS. 5 and 7, and a lower frame structure becomes moveable within the upper frame structure of probe column assembly support 12. In the preferred embodiment, although not critical, it is contemplated for crank 28 to be attached to a shaft having a circular gear with teeth. As the handle of crank 28 is rotated, the gear teeth are caused to mesh with a linear rack (not shown) rigidly attached to the inside movable frame-within-a-frame system to raise or lower the upper portion of probe column assembly support 12. It is contemplated for the third cantilevered embodiment of robotic system 10 to be manually moved into position over the targeted treatment area on a patient only once prior to the start of an automated treatment routine. Thereafter, due to the increased weight of the cantilevered third embodiment, it is contemplated for movement of probe 20 to be fully automated.

FIG. 7 shows the upper portion of probe column assembly support 12 of the third embodiment of the present invention having horizontal arm 26 movable in the X-axis direction under the upper portion of probe column assembly support 12 with probe column assembly 14 downwardly depending from one end of horizontal arm 26. FIG. 7 also shows probe column assembly support 12 positioned adjacent to the side of patient support table top 46 which is resting on table base 48. FIG. 7 further shows probe column assembly support 12 having wheels 22 positioned under its lower portion for ease in coarse Y-axis adjustment of probe column assembly support 12 between treatment sites. The type and dimension of wheels 22 used is the third preferred embodiment of robotic system 10 is also not critical to the present invention, and although not shown, it is also contemplated to have rollers or other types of movable support members used for movement of the third preferred embodiment of probe column assembly support 12. In addition, FIG. 7 shows the third preferred embodiment of robotic system 10 having motor attached to the lower portion of probe column assembly 14, wiring 18 connected between motor 16 and a remote power source (not shown), and probe 20 having a sharp beveled edge and being attached to th e distal end of the probe column assembly 14 for a substantially 360° arc of movement over a patient (not shown), with probe 20 being able to be moved 180° from a raised horizontal position in one direction to a raised horizontal position in the opposite direction to allow a patient's hand to move probe 20 away from the treatment area at any time and from any direction during a treatment routine when a patient no longer desires treatment. Although not shown, it is also contemplated for motor 16 in the third preferred embodiment of robotic system 10 to be torque limited and current limited, as well as to clutch plates 84 for patient safety in the event of a power surge or equipment failure. Torque limitation can be through the selection of a motor 16 having only the torque necessary to perform it function without excess. It is contemplated for all embodiments of robotic system 10 to provide for a maximum of approximately two-and-one-half feet of coarse X-axis and Y-axis adjustment of probe 20, although the maximum controlled probe working area is twelve inches, with Z-axis adjustment of probe 20 relative to a patient being approximately six inches in all embodiments.

Figure 8:
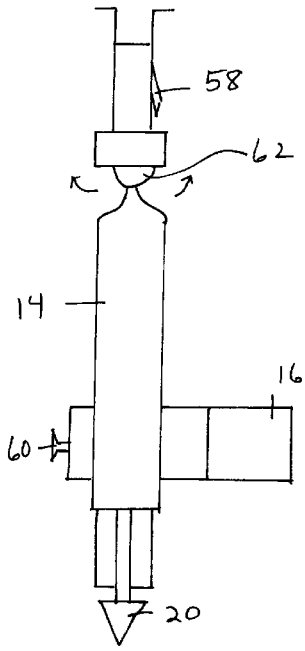
FIG. 8 is an enlarged side view of a probe column assembly which can be used in all embodiments of the present invention having a quick release mechanism, a swivel joint, a tension control knob, and a beveled probe connected to its distal end.
Figure 11:
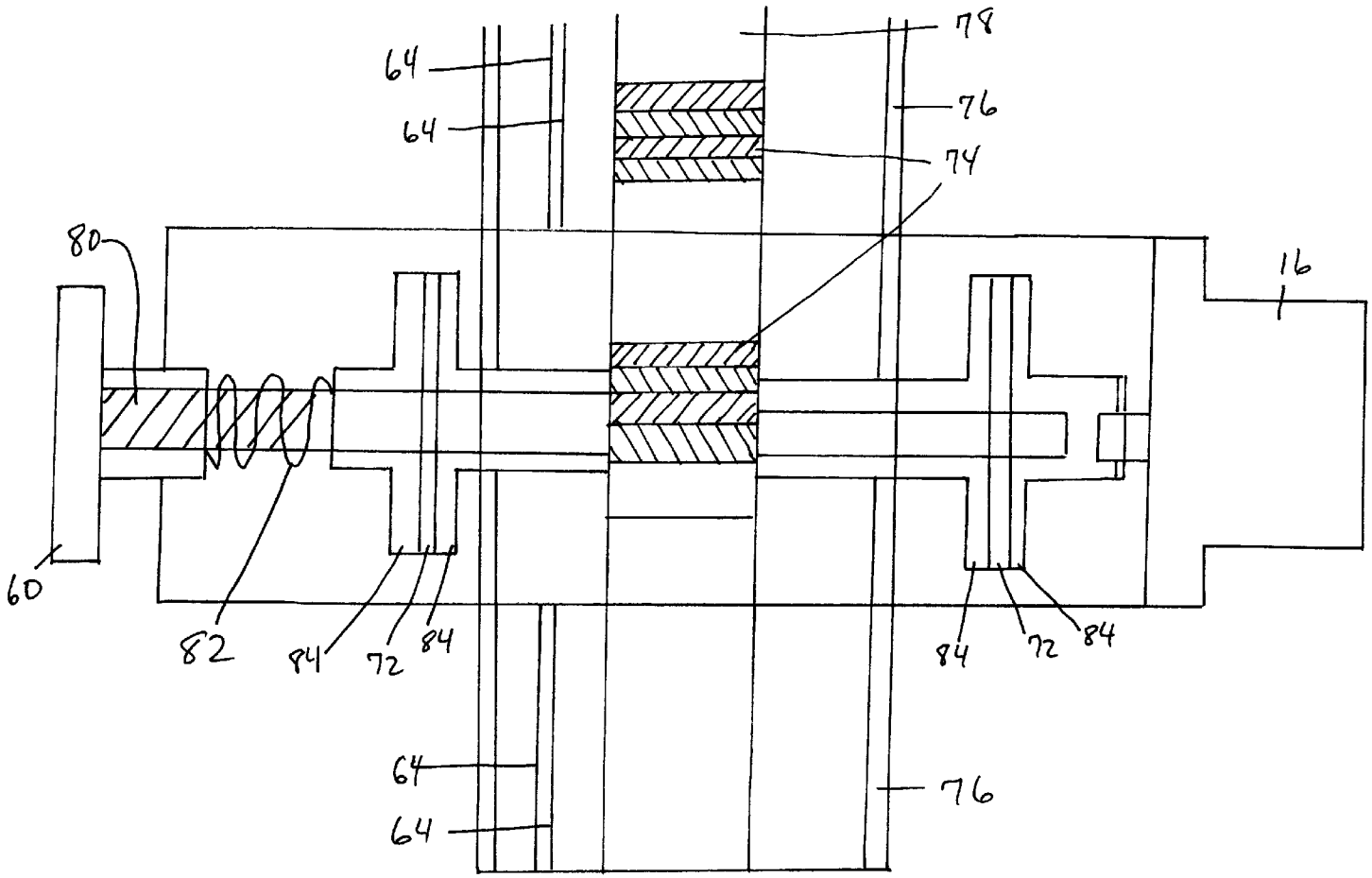
FIG. 11 is a sectional side view of the probe column assembly of the present invention having a motor, spring means, clutch plates, a tension control knob, gears, sensor wiring, a housing, and a movable rod within the housing, the clutch plates being a patient safety feature that allows slippage in the event of motor failure.

FIG. 8 shows probe column assembly 14 having a quick release mechanism 58, a swivel joint 62, motor 16, and a tension control knob 60. It is contemplated for quick release mechanism 58 to be used to break the rigidity of swivel joint 62 and allow easy placement of probe 20 at different angles relative to a patient (not shown) for optimal positioning of probe 20 relative to targeted muscles in the controlled probe working area during treatment. In FIG. 8, quick release mechanism 58 is shown to comprise a lever connected to one end of a tension spring 82 with a tension control screw 66 connected to the other end of the spring, similar to the spring 82 and rod 80 used in tension control knob 60 to control applied pressure, as shown in FIG. 11. Tension control knob 60 is used as one of several limitations provided for patient safety and pre-sets a maximum level of pressure possibly exerted by probe 20 against muscle tissue, beyond which probe 20 reverses direction of movement due to slipping clutch plates 84, so that instead of moving toward the patient as during a treatment routine, probe 20 will be caused to move away from the patient, should pressures in the muscle tissue exceed the patient's tolerance level or in the event of equipment malfunction. Other safety limitations include the selection of a torque-limited and current-limited motor 16 with clutch plates 84 as shown in FIG. 11, such as a small hobby motor, so that sufficient torque is available to allow probe 20 to apply over one hundred pounds of pressure to patient muscles, but at the same time limited so as to not cause patient injury even in the event of a power surge or sudden equipment malfunction. The electrical current available to motor 16 from a remote power source (not shown), in addition to limitation built into motor 16 itself, can also limited by computer 90 as well as other non-computerized external devices (not shown) to avoid patient injury in the event of motor 16 malfunction. As shown in FIG. 11, tension control knob 60 is connected to a clutch plate 84, and by adjusting tension control knob 60 to different maximum pressure settings according to each patient's condition, the clutch plates 84 are caused to slip when the maximum pre-set pressure in tissues is exceeded whereafter probe 20 is caused to immediately retreat from its treatment position. Motor 16 must be chosen so that its mechanical limitation is sufficient to avoid harm to a patient even when tension control knob 60 is tightened down to its maximum pressure setting. Also, it is also contemplated for swivel joint 62 to include quick release mechanism 58 as a safety feature to permit a substantially 360° arc of movement of probe 20 over a patient, with the capability of moving 180° from a raised horizontal position in one direction to a raised horizontal position in the opposite direction so that probe 20 can be moved away from its typically downwardly depending treatment position by a patient's hand at any time and in any direction should a patient no longer desire to receive treatment. The swivel joint 62 and quick release mechanism 58 combination is designed so that there is enough resistance therein to provide adequate pressure at the probe angle selected for therapy, but at the same time has enough give that a patient moving or pushing probe column assembly 14 by hand can break the resistance and move probe column assembly 14 out of the treatment position. This would allow for patient intervention similar to a manual muscular therapy situation where a therapist would be trying to apply one hundred pounds of force to muscle tissue with his or her knuckles. For example, if a patient were lying on his or her stomach on a treatment table and the patient's shoulder muscles were targeted for treatment, the therapist would place a knuckle straight into the patient's shoulder trying to simulate a beveled treatment edge. In doing so, the therapist's legs would be moved back away from the table with the therapist leaning over the patient with straightened arms and applying a large force to the patient's shoulder. Should the patient then move, due to the unstable position of the therapist, the therapist could be caused to fall and result in the pressure being removed. Also, if treatment was being conducted in the patient's thoracic area and the patient sneezed, the probe would have sufficient give so that injury to the patient is avoided. In the event of malfunction or if a patient no longer desires to receive treatment, tension control knob 60 can also be used by the patient or muscular therapist to promptly diminish pressure applied by probe 20.

Figure 9:
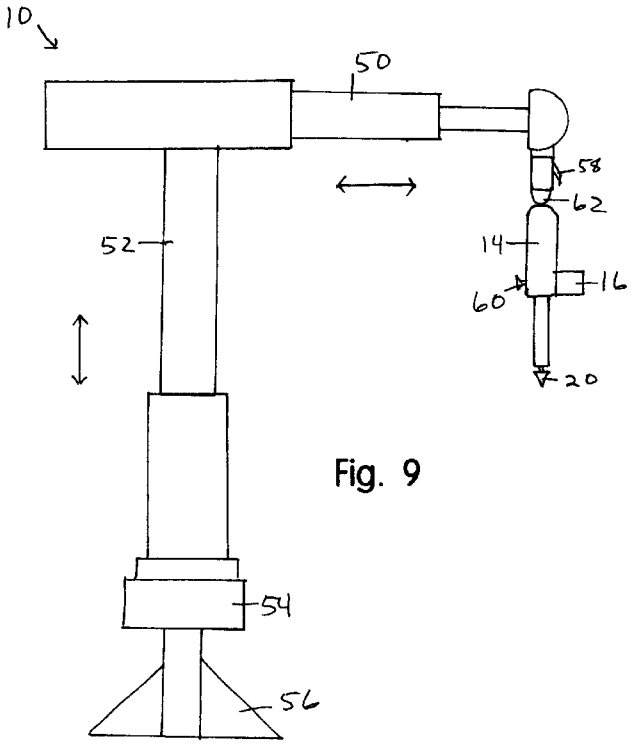
FIG. 9 is a partial side view of a fourth embodiment of the present invention having the probe column assembly connected to a cartesian probe column assembly support for movement of the probe in X, Y, and Z directions

FIG. 9 shows probe column assembly support 12 for the fourth preferred embodiment of robotic system 10 having a base member 56, a brake drum 54, a telescoping vertical portion 52, a telescoping horizontal portion 50, and probe column assembly 14 downwardly depending from the distal end of telescoping horizontal portion 50. FIG. 9 also shows probe column assembly 14 having a quick release mechanism 58 for use in placement of probe 20 at different angles relative to a patient (not shown) by breaking the rigidity of swivel joint 62 so that probe 20 is easy to move out of its treatment position by a patient no longer desiring treatment for any reason. Tension control knob 60 is connected to clutch plates, shown in FIG. 11 by the number 84, and is used in combination with clutch plates 84 as a safety mechanism to cause reversal of the direction of movement of probe 20, so that instead of moving toward the patient during a treatment routine, probe 20 will be caused to move away from a patient, should pressures in tissues exceed the patient's pre-set tolerance level, in the event of equipment malfunction, or if the patient would grab the probe in an attempt to stop treatment. Although such configuration is not critical, in FIGS. 8 and 9 quick release mechanism 58 is shown to have an elongated lever for easy hand manipulation to provide quick interruption of treatment routines. Telescoping vertical portion 52 which moves in the Z-axis direction and telescoping horizontal portion 50 which takes care of positioning in the X-axis and Y-axis directions are used to provide the two-part frame-within-a-frame coarse positioning of probe 20 over a patient (not shown) prior to the start of a treatment routine. Brake drum 54 is used to control rotation of telescoping vertical portion 52. The drive mechanism for the different components of the fourth embodiment of the present invention are not critical and any type of drive mechanism can be used. Although not shown it is contemplated to have an external button, lever, or the like which is appropriate to the selected drive mechanism, to lock telescoping vertical portion 52 into position once probe column assembly 14 is optimally adjusted relative to a patient. No wheels 22 are shown in FIG. 9 attached to the bottom of base member 56 as it is contemplated that the telescoping probe column assembly support in the fourth embodiment of the present invention to be weighted and balanced to provide stable support for probe 20 at all times without having to be bolted to the floor. FIG. 9 further shows probe column assembly 14 having a swivel joint 62 which permits movement of probe 20 in a substantially 360° arc over a patient. Swivel joint 62 also permits movement of probe 20 in 180° arc over a patient from one approximately horizontal position to a horizontal position 180° opposed thereto in any direction, and permits optimum angular positioning of probe 20 relative to targeted muscles (not shown) since all patient muscles will not be able to be effectively treated with probe 20 in a perfectly vertical position. In addition, FIG. 9 shows motor 16 attached to probe column assembly 14 between swivel joint 62 and probe 20.

Figure 10:
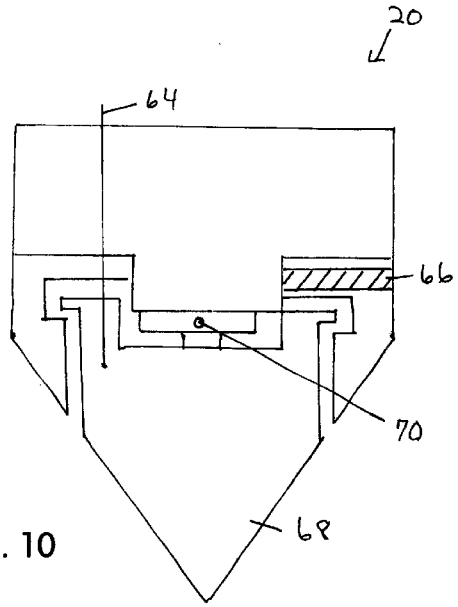
FIG. 10 is a sectional side view of a beveled probe of the present invention having a removable pressure applicator and sensor wiring.
Figure 13:
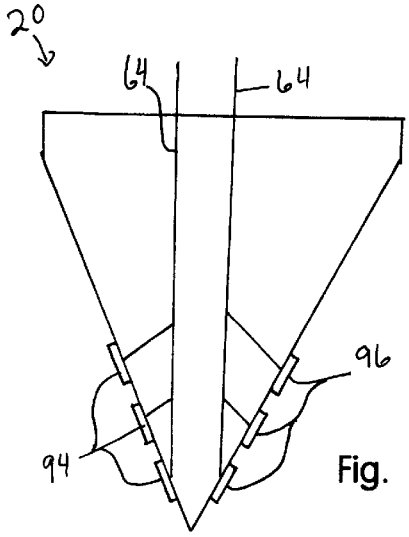
FIG. 13 is a sectional side view of a beveled probe of the present invention having sensor wiring, a plurality of EMG units which require three contact points to function, and a plurality of TENS unit applicators attached thereto which require two contact points to function.

For use in all embodiments, it is contemplated for probe 20 to be either configured as a one-piece unit, or in the alternative to have a removable pressure applying portions with different beveled configurations and different combinations of data collecting sensor units, such as those shown in FIG. 13 by the numbers 94 and 96. FIG. 10 shows a preferred embodiment of probe 20 comprising a separate pressure applicator portion 68, with a sharp beveled pressure-concentrating treatment edge. Use of this embodiment of probe 20 would permit easy exchange of sensor units in the event of malfunction or when TENS applicators are needed instead of sensor units or in addition to them. FIG. 10 also shows a set screw 66 used to attach pressure applicator portion 68 to the remainder of probe 20. FIG. 10 further shows sensor wiring 64 connected within probe 20 and a load cell 70 used to measure applied pressure.

FIG. 11 shows probe column assembly 14 having a cylindrical-shaped housing 76, a rod 78 centrally positioned within housing 76, gears 74 attached to rod 78 for use in raising and lowering probe 20, and sensor wiring 64 also positioned within housing 76 for use in gathering patient data during treatment routines. In addition FIG. 11 shows probe motor 16 connected against one side of housing 76, with tension control knob 60 also attached to housing 76 in a position opposed to motor 16. FIG. 11 shows tension control knob 60 connected by a threaded rod 80 to one end of a spring 82, the other end of spring 82 being in contact with a clutch plate 84. As tension control knob 60 is turned, threaded rod 80 compresses spring 82 to engage clutch plate 84 for adjustment of the maximum pressure which will be applied to patient tissues before clutch plates 84 are caused to slip and probe 20 is made to reverse direction and retreat from the region of the patient undergoing treatment. FIG. 11 also shows a layer of cork 72 positioned against clutch plates 84.

Figure 12:
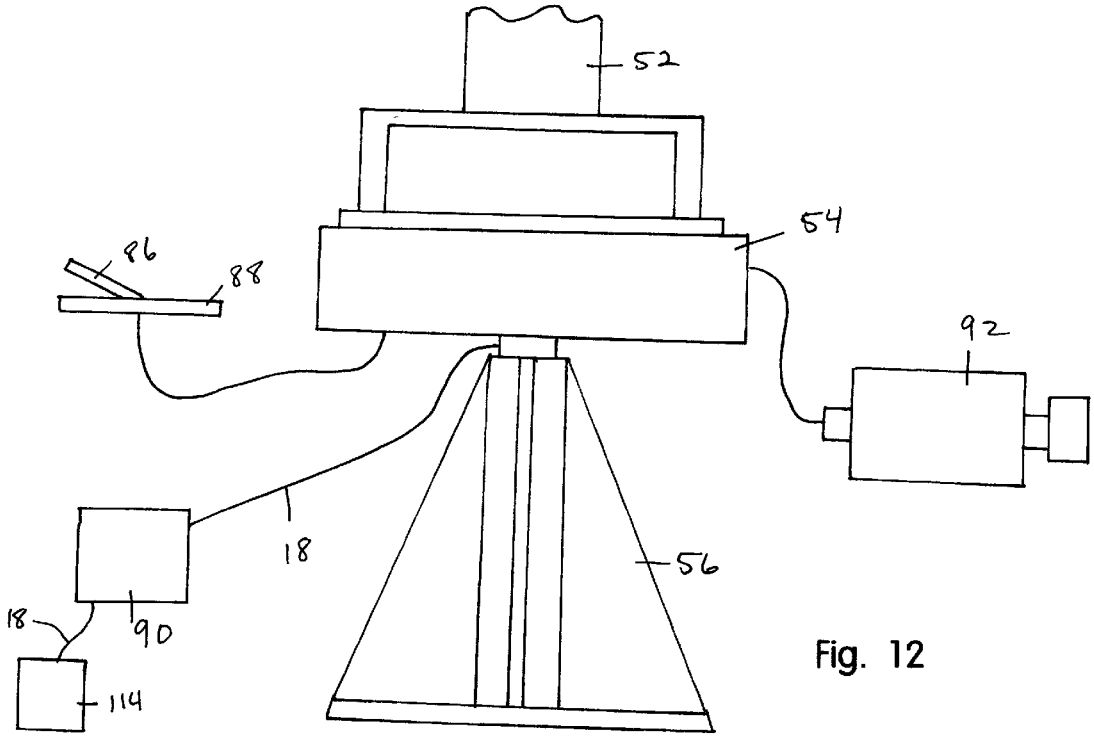
FIG. 12 is a side view of the base portion of the fourth embodiment of the probe column assembly support of the present invention having a brake, a telescoping vertical mechanism, a base member, a solenoid, and computer means connected thereto, with a computer control device connected to the computer means.

FIG. 12 shows the lower portion of probe column assembly support 12 having base member 56 connected to telescoping vertical mechanism 52 with brake drum 54 positioned therebetween. FIG. 12 also shows a solenoid 92, a brake lever 86, and a brake lever support 88 connected to brake drum 54. In addition, FIG. 12 shows the electrical connection of a computer means 90 to probe column assembly support 12 through wiring 18 and a computer control device 114 connected to computer means 90. Although not critical to robotic system 10, in the preferred embodiment it is contemplated for computer control device 114 to be selected from a group consisting of a joystick, a keyboard, remote push button controls, voice-activated controls, and infrared-activated controls. In the fourth preferred embodiment of robotic system 10, although not shown, it is contemplated for input to computer means 90 to include, but not be limited to, signals from infrared controllers and other patient movement monitoring devices including an X-Y array shown in FIG. 16 as number 112 which can be positioned under a patient; joystick controllers; keyboards; push button controllers; tissue force shearing sensors; strain gauges to measure force; EMG sensors; X-Y encoders attached to probe column assembly support 12 and patient support table top 46; limit switches; other sensors attached to probe 20; and other operator initiated action. In the fourth preferred embodiment of robotic system 10, it is contemplated for output from computer means 90 to include, but not be limited to, signals to the X-Y positioning table motors (not shown); motor 16; telescoping horizontal mechanism 50; telescoping vertical mechanism 52; and the TENS units, shown in FIG. 13 as number 94, which are attached to probe 20.

FIG. 13 shows sensor units 96 and TENS units 94 attached through the outer surface of probe 20. TENS unit applicators are treatment devices which when connected to the probe administer electrical stimuli to a patient's muscles. Sensor wiring 64 is shown connecting sensor units 96 together and extending through probe 20 for ultimate connection to computer means 90, shown in FIG. 12 as being attached to the lower portion of probe column assembly support 12. In the preferred embodiment of robotic system 10 it is contemplated for sensor units 96 to comprise devices for measuring EMG units, force, and tissue force shearing, as well as other parameters for the gathering of data which would help muscular therapists quantify patient progress and a patient's ability to return to work following injury. In the preferred embodiment it is contemplated for more than one type of sensor unit 96 to be attached to probe 20 at one time, as well as to have removable pressure applicators 68 for probe 20, as shown in FIG. 10, which each contain a single type of sensor unit 96, or combinations of several types of sensor units 96, for quick and convenient installation of different sensor units 96 to probe 20 as needed to quantify patient progress. However, sensor units 96 measuring electrical activity in muscle tissue in EMG units requires three contact points, whereas the measurement of slippage requires one contact point in combination with a distance measurement of probe movement. TENS units 94 require two contact points on probe 20.

Figure 14:
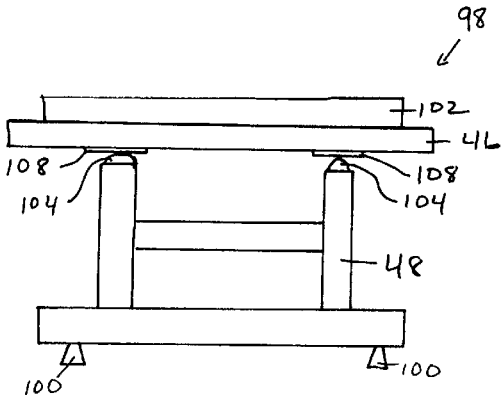
FIG. 14 is an end view of an X-Y positioning patient support, commonly six feet long by three feet wide by six inches deep, used with the fourth embodiment of the present invention having a table top, padding positioned on the upper surface of the table top, a base support for the table top with bearings thereon upon which the table top is positioned, and non-moving feet attached to the lower surface of the base support.

FIG. 14 shows a preferred embodiment of an X-Y positioning patient support 98 for optional use in the fourth embodiment of the present invention comprising cartesian probe column assembly support 12. FIG. 14 shows X-Y positioning patient support 98 comprising a quantity of flexible padding 102 centrally positioned on table top 46. Padding 102 is of adequate size to support the body of a patient (not shown) and substantially cover table top 46. Although the material from which padding 102 is made and its thickness are not critical to the present invention, padding 102 must allow a patient (not shown) to be comfortably positioned on table top 46 during muscular therapy treatments. In the preferred embodiment of robotic system 10, padding 102 is approximately twenty-four inches in width and approximately eighty-four inches in length, being attached over the top surface of a piece of wood (not shown) of the same dimension which is at least one inch in thickness. In the preferred embodiment, the combined thickness dimension of the wood and flexible material comprising padding 102 is approximately two inches. Also although not shown, in the preferred embodiment it is contemplated for a headrest to be positioned on the upper surface of padding 102 near to one of its ends. It is also contemplated for padding 102 to have a cut-out portion on one of its ends for insertion therein of a headrest (not shown). In the preferred embodiment, such a headrest would have an approximately oval configuration with its thickness varying between approximately two-and-three-fourths inches and three-and-one-half inches. The head rest would also be configured to allow the patient to be comfortably positioned during muscular therapy treatment. However, the material from which such a headrest would be made and its thickness would not be critical to the present invention. Also, although the dimension of table top 46, and the type of material from which it is made, are not critical to the present invention, in the preferred embodiment, it is contemplated for table top 46 to be made from laminated wood, preferably hard maple, and to have length, width, and thickness dimensions of approximately ninety-six inches, thirty-six inches, and at least one inch, respectively, with all edges and rough areas sanded smooth. An X-Y array of pressure sensitive cells, such as that shown in FIG. 16 as number 112, can be positioned within padding 102 as one means of monitoring patient movement. Although not shown, other means of detecting patient movement in embodiments of the present invention can consist of closure switches provided by one or more infrared detectors, such as infrared sending unit 116 and infrared receiving unit 118 shown in FIG. 16, or even one or more simple mechanical contact switches, positioned under, along side of, or on top of the patient and supported by the present invention frame or on the probe. Below table top 46, FIG. 14 shows a table base 48 having an essentially H-shaped configuration positioned upon non-moving support feet 100. Although an H-frame configuration is shown, such H-frame construction is not critical to robotic system 10. In the preferred embodiment the components of table base 48 are welded together to provide strong support for table top 46. Also, although the materials from which table base 48 are made are not critical to the present invention, in the preferred embodiment it is contemplated for the components of table base 48 to be made of aluminum. FIG. 14 further shows bearing plates 108 attached to the underside surface of table top 46 and each bearing plate 108 supported upon a bearing assembly 104 attached to the upper portion of table base 48.

Figure 15:
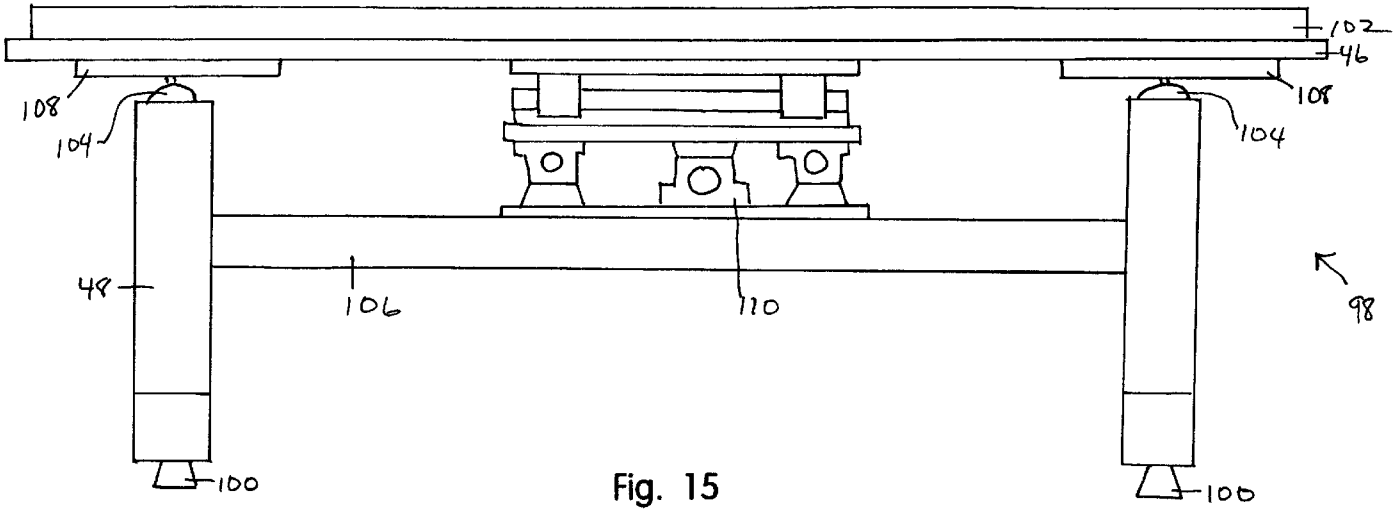
FIG. 15 is a side view of the patient support used with the fourth embodiment of the present invention having a table top, padding positioned on the upper surface of the table top, a base support for the table top with bearings thereon upon which the table top is positioned, and a linear bearing system positioned between the base support and the table top and upon which the table top rests for X-Y movement of a patient positioned upon the padding.

FIG. 15 shows X-Y positioning patient support 98 having bearing plates 108 on the underside surface of table top 46, adjacent to each of its ends, each supported upon one bearing assembly 104 positioned on the upper surface of each end of table base 48. FIG. 15 also show table base 48 having a cross bar 106 with an X-Y movement control means 110 centrally positioned thereon and connected between the underside surface of table top 46 and the upper surface of cross bar 106. Although not critical, in the fourth preferred embodiment of robotic system 10 it is contemplated for X-Y movement control means 110 of patient table top 46 to comprise two conventional linear bearing systems positioned perpendicular to one another with the extent of movement in both X and Y directions limited to approximately twelve inches. In the preferred embodiment the linear bearing systems of X-Y movement control means 110 would be made of aluminum. It is contemplated for the upper surface of X-Y movement control means 110 to be securely attached to the underside surface of table top 46, and for the lower surface of X-Y movement control means 110 to be securely attached to the upper surface of cross bar 106. FIG. 15 also shows pad 102 positioned upon the upper surface of table top 46 and non-moving support feet 100 positioned beneath table base 48. Although not critical, in the preferred embodiment, non-moving support feet 100 would comprise adjustable leveling feet. In the preferred embodiment, the optimum height from the top of table top 46 to the bottom of support feet 100 is approximately twenty-six inches. Also, although the thickness of each bearing plate 108 is not critical to the present invention, each bearing plate 108 must be substantially identical in thickness to each of the other bearing plates 108 in use. In the preferred embodiment it is contemplated for bearing plates 108 to be made from stainless steel and to be approximately twelve inches square, with a thickness of approximately one-eighth of an inch and capable of moving smoothly and freely over the bearing assembly 104 beneath it. Although not shown, it is contemplated for each linear bearing system of X-Y movement control means 110 to be connected to an independent motor, computer control means 114 such as a joystick or a voice-activated control device, and computer means 90, so that a choice of manual means or automated computerized means may be employed for movement of table top 46. It is critical that the type of independent motors used are step motors which accept positioning commands and which also have linear encoders for sending position information back to computer means 90. It is also important for the independent motors to be able to smoothly move table top 46 in X-Y directions relative to table base 48 within a small easily controllable treatment area, contemplated to be approximately twelve square inches in the preferred embodiment.

Figure 16:
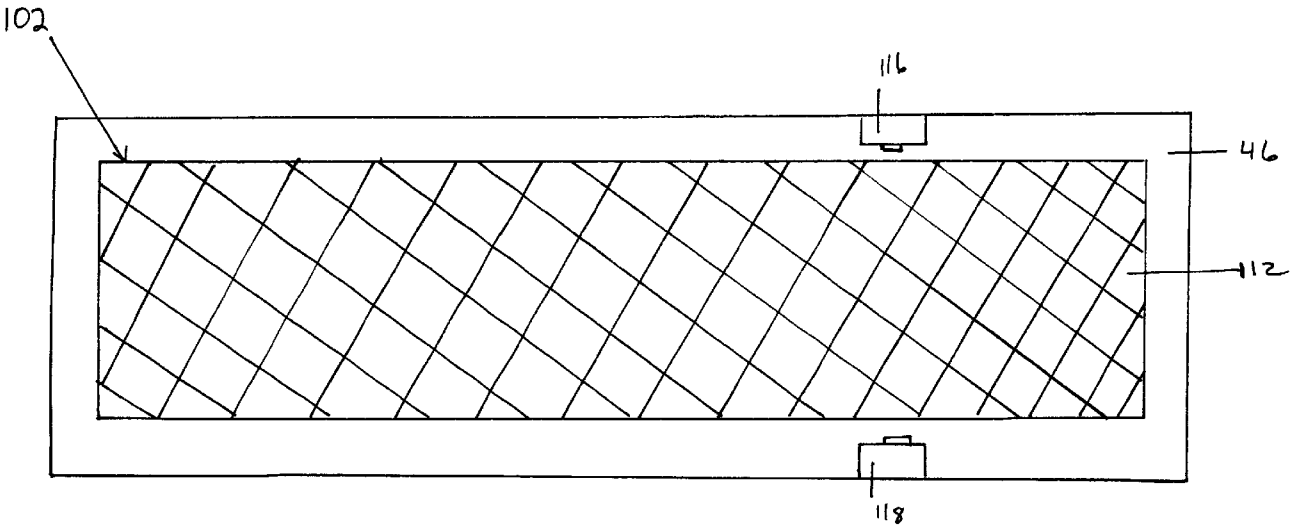
FIG. 16 is a top view of the upper surface of the patient support used with the fourth embodiment of the present invention having padding and an array of pressure sensitive cells within the padding.

FIG. 16 shows a pad 102 comprising an X-Y array pad 112 of pressure sensitive cells positioned on top of the upper surface of table top 46 for monitoring patient movement, particularly during automated treatment routines. Although not critical to the present invention, in all preferred embodiments use of X-Y array pad 112 is contemplated as an optional safety feature to robotic system 10. Although not shown in FIG. 16, X-Y array pad 112 is connected to computer means 90. Therefore, during automated treatment routines if any portion of the patient moves, computer means 90 is promptly made aware of the movement and evaluates how the movement affects patient safety. If the movement was not adjacent to the area of the patient being treated by probe 20, computer means 90 would be programmed to take no action. However, if patient movement was determined by computer means 90 to put the patient at risk, such patient movement would cause computer means 90 to immediately reverse the forward movement of probe 20 toward the patient and cause probe 20 to retreat from the patient.

FIG. 16 also shows infrared sending unit 116 and infrared receiving unit 118 which together provide a focused infrared beam (not shown) therebetween which can serve as another means for monitoring patient movement during treatment routines. Also not critical to the present invention, in all preferred embodiments use of infrared sending unit 116 and infrared receiving unit 118 is contemplated as an optional safety feature to robotic system 10. During use, infrared sending unit 116 and infrared receiving unit 118 are placed on opposite sides of the targeted treatment area and supported by table top 46. More than one pair of infrared sending units 116 and infrared receiving units 118 may be used. The means of supporting infrared sending unit 1 16 and infrared receiving unit 118 are not critical, and it is within the contemplation of the present invention for infrared sending unit 116 and infrared receiving unit 118 to be attached to probe column assembly support 12, table top 46, or on independent support stands (not shown). Basically, infrared sending unit 116 and infrared receiving unit 118 would either need to make a contact closure or opening for continuity of electrical current and in the alternative could include such primitive means as a simple mechanical contact switch strategically positioned against the patient to detect patient movement. FIG. 16 shows infrared sending unit 116 and infrared receiving unit 118 supported on either sides of table top 46. When a patient (not shown) being treated by probe 20 moves and breaks the strategically located focused infrared beam generated between infrared sending unit 116 and infrared receiving unit 118, probe 20 is caused to reverse its direction and retreat from the patient.

To use robotic system 10, a body part of a patient (not shown) requiring muscular therapy treatment would be placed under the sharp beveled edge of probe 20 and motor 16 would be activated by the patient, or a therapist, to cause probe 20 to incrementally move forward against the patient's skin so as to repeatedly apply pressure to targeted muscle layers one-at-a-time to the point of discomfort for periods up to approximately ten minutes to lengthen them and restore normal blood flow to muscles having extended duration contraction occurring as a result of strenuous exercise or spasm, thus freeing each successively treated muscle layer for peak performance, increasing flexibility in joints previously adversely affected by the treated muscles, and eliminating pain resulting from excess muscle contraction. The beveled edge of probe 20 would be sufficiently sharp to effect treatment, but not sharp enough to injure the patient's skin during the slow incremental advance of probe 20 against an average patient's skin. Pressures exceeding one hundred pounds of pressure can be applied with probe 20 to give the patient's treated muscles greater stamina, more leverage, increased power and accuracy, as well as a faster recovery period following exercise.

During use of the embodiments of robotic system 10 having the overhead sliding-type of probe column assembly support 12, or the gantry-type of probe column assembly support 12, the probe column assembly 14 is manually moved relative to the patient between treatment routines for coarse X, Y, and Z adjustment of probe 20 relative to the patient. While the cantilevered and cartesian embodiments of robotic system 10 can also be manually moved relative to a patient to provide coarse X, Y, and Z positioning of probe 20, due to their larger size and configuration such embodiments are each also programmable for coarse X, Y, and Z movement of probe 20 relative to a patient. Fine adjustment of probe 20 is achieved through motor 16. It is contemplated for all embodiments of the present invention to be capable of creating and executing automated treatment routines, with any probe column assembly support being outfitted with any level of automation. However, as automation is added, portability generally becomes diminished. In all preferred embodiments an easily controlled probe work area is limited to approximately twelve square inches in X-axis and Y-axis directions and six inches in the Z-axis direction. After each treatment routine, the positions of both the patient and probe 20 can be readjusted relative to one another in preparation for treatment of additional muscle tissue. It is contemplated for all embodiments, but particularly the cantilevered and cartesian embodiments, to be connected to an uninterrupted power source for use during power outages. Automated treatment routines on a patient can be initiated with all of the preferred embodiments after two bony landmarks on the patient are identified. Also, individualized automated treatment routines can be created for patients with special needs by placing the present invention in a learn mode wherein a therapist will move probe column assembly 14 and probe 20 through specific treatment areas on a patient while identifying certain treatment protocol, including the quantification of pressures to be used during the automated treatment routine and the contemplated duration of each. Once the specialized treatment routines are established, the therapist would subsequently start them after identifying for the computer two bony landmarks on the patient, the identity of the patient, and the position of the probe relative to the patient. It is also contemplated to have wireless remote control of probe 20 through the use of radio frequency devices, voice-activated control devices, and infrared-activated control devices. It is further contemplated for the preferred embodiments of the present invention enhance patient safety through the use of patient movement monitoring devices including pressure cells (not shown), infrared devices such as infrared sending unit 116 and infrared receiving unit 118, and even simple mechanical contact switches (not shown) placed on top of a patient, under a patient, or along side of a patient or on the probe can be further used to enhance patient safety by causing probe 20 to reverse its forward movement toward a patient and retreat from the patient should he or she move so as to break contact within the monitoring device. In addition, although not shown, it is contemplated for the present invention to have an emergency kill-switch, which upon activation would cause probe 20 to reverse direction and retreat to a position remote from the patient. It is contemplated for column probe assembly 14 to be put into position relative to the orientation of a patient positioned on table top 46 only once at the beginning of a treatment routine on a prone patient, after which probe 20 is positioned substantially vertical to the patient and placed at the angle relative to the patient desired for optimum muscle treatment.

It is contemplated for the data gathering capabilities of the present invention to include the collection of information about the treatment performed, including such measurements as the force applied and the shear forces encountered, as well as the amount of tissue lengthening achieved, and for such information to be correlated in a quantified manner with the amount of soft tissue injury remaining in a patient to plot the progress of the patient during successive treatments for a determination as to whether the current amount of contraction encountered in a patient's muscle is the same, greater, or less than on previous visits to the treatment facility. Should the contraction stay the same or increase, the patient can be checked by a physician for such conditions as nerve entrapment, bone or muscle compression, nerve damage, and torn tissue. It is anticipated that in the future the net values associated with tissue contraction, as determined by the present invention, could also be correlated to percentage values assignable in the future by the National Institute of Health, insurance companies, or other similar organization, to various disabilities so that as the progress of each patient is plotted, such information would provide insurance companies with a quantified assessment of a patient's ability to return to work as injured tissues heal.

I claim:

1. A robotic apparatus for giving automated and semi-automated muscular therapy treatments to targeted points of spasms in patient muscles, for increasing joint flexibility and eliminating pain due to excess muscle contraction, including points of spasm in deeply layered muscle tissue which are not easily reached by other forms of automated and non-automated treatment, said robotic apparatus being capable of applying a maximum force of approximately one hundred pounds to the excessively contracted muscle fibers at such points of spasm, with greater frequency, uniformity, safety to both patient and therapist, and precision than can be provided manually by therapists with knuckles and hand-held bevel-edged pressure bars to effect a superior result over the manual treatment procedures from which said robotic apparatus has evolved, such applied force releasing acids built up in treated muscle tissue and lengthening muscle fibers, with resulting patient benefit following treatment being immediate pain reduction and increased flexibility, said robotic apparatus comprising:

a probe column assembly having a proximal end and a distal end, said probe column assembly having a swivel fitting between said proximal end and said distal end, said swivel fitting being configured to permit movement of said distal end in a substantially 360° arc over a patient and also configured to allow said probe to move through approximately 180° from a raised approximately horizontal position in any one direction to a raised approximately horizontal position in the opposite direction, said swivel fitting configured from materials able to provide a maximum axial resistance in said probe column assembly of approximately one hundred pounds of force and a distal end which can be easily pivoted away from a substantially downwardly depending treatment position, said swivel fitting configuration also providing sufficient yield to accommodate slight patient movement without injury, said probe column assembly also comprising a quick release mechanism connected to said swivel fitting and configured to fix said distal end relative to said proximal end in any direction at an angle not exceeding 90°;

at least one probe having a beveled treatment edge and being detachably connected to said distal end of said probe column assembly so that said beveled treatment edge is placed during use into a position opposed to said swivel fitting, said beveled treatment edge being adapted to concentrate a maximum applied force of approximately one hundred pounds to a precise point of spasm on targeted muscle tissue subsequent to a slow and incremental advance of said beveled treatment edge toward a patient during treatment, said probe being adapted for direct and sheer force measurement according to encountered muscle hardness;

a probe motor electrically connected to said probe, said motor being attached to said probe column assembly between said swivel fitting and said distal end, said probe motor having limited torque which is merely adequate for incremental moving of said probe against a patient at a maximum force of approximately one hundred pounds, said probe motor also having external torque limiting means adapted for preventing said probe from applying force in excess of one hundred pounds to muscle tissue, said probe motor also having current limiting means independent from said torque limiting means adapted for preventing excess amounts of electrical current from reaching said motor which would cause said probe to apply force higher than one hundred pounds to muscle tissue, said motor also having a slip clutch configured for reversing advance of said probe toward a patient when excess electrical current in said probe motor is detected as well as when a maximum desired applied force against muscle tissue is achieved, as determined by said direct and sheer force measurement according to encountered muscle hardness, said slip clutch having an adjustable tension control;

a plurality of interchangeable probe column assembly supports each having a two-part frame structure permitting movement of a first frame part relative to a second frame part, each of said supports having a sturdy base configuration balanced for stability during treatment routines involving maximum muscle tissue application forces of approximately one hundred pounds without having to be secured to a supporting floor surface, each of said supports further having a first movement means for coarse X-axis, Y-axis, and Z-axis movement of said distal end relative to a patient with X-axis movement being in the direction of a patient's head to the patient's feet, Y-axis movement being in the direction of the left side of a patient to the patient's right side, and Z-axis movement being in a vertical direction relative to the ground;

said probe column assembly comprising a second movement means adapted for fine X-axis, Y-axis, and Z-axis movement of said distal end relative to a patient, said second movement means including said probe motor;

computer means connected to said second movement means and adapted for automated movement of said distal end within a defined probe working space having an X-axis dimension of approximately twelve inches, a Y-axis dimension also of approximately twelve inches, and a Z-axis dimension of approximately six inches said computer means also adapted for interpretation of said direct and sheer force measurement according to encountered muscle hardness, detection of excess probe motor current, and reverse advancement of said probe when a maximum pre-set amount of probe motor current or applied force against targeted muscle tissue is achieved;

controller means connected to said computer means and adapted for semi-automated movement of said distal end within a defined probe working space having an X-axis dimension of approximately twelve inches, a Y-axis dimension also of approximately twelve inches, and a Z-axis dimension of approximately six inches; and electrical connection means adapted for connecting said second movement means to said probe, said computer means to said second movement means, said controller means to said computer means, and said computer means to an external power source so that said probe can be made to slowly, incrementally, and safely apply increasingly concentrated force up to a maximum of approximately one hundred pounds while accounting for slippage and sheering forces, to layered muscle tissue at the precise site of a muscle spasm to lengthen even the most deeply positioned muscle tissue at the treatment site and eliminate pain that had been caused by the excess contraction.

2. The apparatus of claim 1 wherein said computer means is also electronically connected to said first movement means for additional coarse X-axis, Y-axis, and Z-axis adjusting capability of said distal end.

3. The apparatus of claim 1 wherein a selected one of said column assembly supports comprises a sliding upright-type of portable structure wherein said first frame part includes a horizontal cross bar extending between two side supports, said probe column assembly is removably connected to said cross bar and downwardly depends from said cross bar during treatment, and wherein said first movement means is selected from a group consisting of non-automated means capable of coarse X-axis movement of said second frame part relative to a patient, non-automated means capable of coarse Y-axis movement of said probe column assembly relative to said first frame part, and non-automated means capable of coarse Z-axis movement of said first frame part relative to said second frame part.

4. The apparatus of claim 1 wherein a selected one of said column assembly supports comprises a gantry-type of upright portable structure and wherein said first frame part includes a horizontal cross bar extending between two side supports, said second frame part has an open lower construction ranging between approximately twenty-four and thirty-six inches to allow movement of said structure over a patient support with a patient lying thereon, said probe column assembly is removably connected to said cross bar and downwardly depends from said cross bar during treatment, and wherein said first movement means is selected from a group consisting of non-automated means capable of coarse X-axis movement of said second frame part relative to a patient, non-automated means capable of coarse Y-axis movement of said probe column assembly relative to said first frame part, and non-automated means capable of coarse Z-axis movement of said first frame part relative to said second frame part.

5. The apparatus of claim 1 wherein said computer means is connected to said first movement means, wherein a selected one of said column assembly supports comprises a cantilevered upright portable structure having an upper frame portion and a lower frame portion configured for movement close to a patient support of sufficient size to support an average human adult in prone and supine positions thereon, wherein said first frame part includes said upper frame portion having a horizontal arm connected in a cantilevered manner relative to said upper frame and an inner arm member within said horizontal arm, and wherein said second frame part includes said lower frame portion, said probe column assembly is removably connected to said underside surface and downwardly depends therefrom, during treatment, and said first frame part includes said upper frame portion, and wherein said first movement means is selected from a group consisting of non-automated means capable of coarse X-axis movement of said second frame part relative to a patient, non-automated means capable of coarse Y-axis movement of said second frame part relative to a patient, and non-automated crank means capable of coarse Z-axis movement of said first frame portion relative to said lower frame portion, automated means capable of coarse X-axis movement of said inner arm relative to said horizontal arm, and automated means capable of coarse Y-axis movement of said horizontal arm relative to a patient.

6. The apparatus of claim 1 wherein said computer means is connected to said first movement means and said first movement means includes a patient support, wherein a selected one of said column assembly supports comprises a cartesian support structure, wherein said first frame part includes a telescoping horizontal mechanism horizontally having a distal end, wherein said probe column assembly is removably connected to said distal end of said telescoping horizontal mechanism and downwardly depends therefrom during treatment, wherein said second frame part includes a telescoping vertical mechanism upwardly depending from a base support, and wherein said first movement means is selected from a group consisting of non-automated means capable of coarse X-axis movement of said second frame part relative to a patient, non-automated means capable of coarse Y-axis movement of said second frame part relative to a patient, non-automated means capable of shortening said telescoping vertical mechanism for coarse Z-axis movement of said telescoping horizontal frame relative to a patient, automated means capable of shortening said telescoping horizontal mechanism for coarse X-axis movement of said probe column assembly relative to a patient, and automated patient support means capable of coarse X-axis and Y-axis movement of said patient relative to said probe column assembly.

7. The apparatus of claim 1 wherein said computer means comprises the capability of maintaining a database and has a learn mode for creation of individualized treatment routines for patients with special needs.

8. The apparatus of claim 5 wherein said horizontal arm is connected to said upper frame portion and centered relative to said upper frame portion for automated coarse and fine X-axis movement of said probe column assembly within said upper frame portion.

9. The apparatus of claim 6 further comprising said automated patient support means capable of coarse X-axis and coarse Y-axis movement of said patient relative to said probe column assembly and an X-Y array attached to said automated patient support to detect movement of a patient undergoing muscular therapy treatment, said apparatus also further comprising connection means for connecting said automated patient support and said and said X-Y array to said computer means so that said computer means can determine when patient movement puts the patient at risk and when patient movement does create risk so that said computer means can cause said probe to stop treatment and reverse its direction of movement upwardly away from the patient.

10. The apparatus of claim 6 further comprising brake means connected to said telescoping vertical mechanism and configured to prevent undesired rotation of said telescoping vertical mechanism during muscle tissue treatment.

11. The apparatus of claim 1 wherein said current limitation means is selected from a group consisting of current-limiting boards electrically connected between said probe motor and said computer, and switch closure means for detecting patient movement including pressure cells positioned on top of a patient, pressure cells positioned under a patient, pressure cells positioned along at least one side of a patient, paired infrared detectors positioned above and below a patient, paired infrared detectors positioned on opposite sides of a patient, simple mechanical switches positioned on top of a patient, simple mechanical switches positioned under a patient, and simple mechanical switches positioned in contact with a side of a patient.

12. The apparatus of claim 1 wherein said adjustable tension control for said probe motor comprises a threaded rod, a tension control knob, and a spring; and wherein threaded rod is connected to said tension control knob, said spring is positioned to engage one of said clutch plates, and said threaded rod is positioned to engage said spring.

13. The apparatus of claim 7 further comprising a plurality of sensors and means for connecting said sensors to said probe, and wherein said electrical means is further configured for connecting said sensors to said computer means so that data quantifying patient progress can be gathered by said computer from said sensors during muscle tissue treatment.

14. The apparatus of claim 13 wherein said sensors are selected from a group consisting of force measuring devices, devices measuring electrical activity in muscle tissue in EMG units, and force shearing measurement devices.

15. The apparatus of claim 7 further comprising a plurality of applicators and attachment means for connecting said applicators to said probe for applying additional forms of treatment to a patient's muscles, and wherein said electrical connection means is configured for connecting said applicators to said computer means so that treatment data can be gathered by said computer means for assessing patient progress.

16. The apparatus of claim 15 wherein said applicators comprise TENS units applicators.

17. The apparatus of claim 1 wherein said first movement means comprises common movement enhancing devices selected from a group consisting of chains, pulleys, gears, gear tracks, drive screws, and springs.

18. The apparatus of claim 1 wherein said controllers are selected from a group consisting of joysticks, keyboards, push-button controllers, wireless remote control devices, radio frequency control devices, voice activated control devices, and infrared control devices.

19. A method of providing automated and semi-automated robotic muscular therapy treatments to targeted points of spasm in the muscles of a patient for increasing joint flexibility and eliminating pain due to excess muscle contraction, including points of spasm in deeply layered muscle tissue which are not easily reached by other forms of automated and non-automated treatment, wherein a maximum force of approximately one hundred pounds is applied to the excessively contracted muscle fibers at such points of spasm, with greater frequency, uniformity, safety to both patient and therapist, and precision than can be provided manually by therapists with knuckles and hand-held bevel-edged pressure bars to effect a superior result over the manual treatment procedures from which said method has evolved, such applied force releasing acids built up in treated muscle tissue and lengthening muscle fibers, with resulting patient benefit following treatment being immediate pain reduction and increased flexibility, said method comprising the steps of:

providing a probe column assembly having a swivel fitting, a proximal end, a distal end, and a motor with limited torque and a slip clutch as safety features, a plurality of column assembly supports; a current-limiting board, a plurality of sharp bevel-edged treatment probes, an X-Y positioning patient support, a plurality of sensors for measuring direct and sheer forces, computer means, a plurality of controllers, and a power source;

selecting one of said treatment probes;

affixing said sensors to said selected treatment probe;

attaching the selected one of said treatment probes to said distal end of said probe column assembly so that said slip clutch will cause said probe to automatically move away from a patient in the event of equipment malfunction or power failure;

manually setting maximum direct and sheer forces at which measurement by said sensors according to encountered muscle hardness will cause said selected treatment probe to automatically retract from a patient;

adjusting said swivel fitting on said probe column assembly so that said swivel fitting has sufficient resistance for probe treatment of muscle tissue through the application of a maximum concentrated force of approximately one hundred pounds;

positioning a patient upon said X-Y positioning patent support with a region on the patient needing treatment facing in an upwardly direction;

selecting one of said column assembly supports;

releasably connecting said proximal end of said probe column assembly to the selected one of said column assembly supports for movement in X-axis, Y-axis, and Z-axis directions;

coarsely positioning said selected column assembly support in X-axis and Y-axis directions relative to said X-Y positioning patient support, where said X-axis direction is from the head of a prone patient to the patient's feet and said Y-axis direction is from the left side of the patient to the patient's right side;

coarsely positioning said probe column assembly in a Z-axis direction above the targeted treatment region on the patient, where said Z-axis direction is vertical to the ground;

optionally positioning said selected treatment probe at an angular orientation relative to the particular muscle tissue requiring treatment;

locking said selected treatment probe into said selected angular orientation during treatment with a quick release mechanism on said probe column assembly;

electrically connecting said computer means to said motor for data transfer only;

providing power to said motor by electrically connecting said current-limiting board between said motor and said power source as a safety feature to prevent applied force beyond one hundred pounds in the event of motor malfunction;

electrically connecting said controller to said computer means;

selecting a power source having a maximum electrical current sufficient to engage said motor for application of probe forces in targeted tissue at a maximum of approximately one hundred pounds;

electrically connecting said selected treatment probe and said sensors to said selected power source;

moving said X-Y positioning patient support to adjust the X-axis and Y-axis of the region of the patient requiring treatment relative to said probe;

using said controller to direct fine X-axis, Y-axis, and Z-axis movement of said probe relative to muscle tissue requiring treatment to define an easily controlled probe treatment area having a maximum Z-axis dimension of approximately six inches, a maximum Y-axis dimension of approximately twelve inches, and a maximum X-axis dimension also of approximately twelve inches; and using said controller to cause said selected treatment probe to move toward the targeted treatment area for repeated application of a maximum force of approximately one hundred pounds to layers of muscle tissue in the treatment area one-at-a-time over a time period not exceeding approximately ten minutes to release built-up metabolic by-products in even the most deeply positioned muscle tissue to lengthen it, the maximum force of up to one hundred pounds applied by said selected treatment probe being determined according to said manually set maximum direct and sheer forces as measured by said sensors according to encountered muscle hardness, as well as measurements of excessive motor current.

20. A method of providing automated and semi-automated robotic muscular therapy treatments to targeted points of spasm in the muscles of a patient for increasing joint flexibility and eliminating pain due to excess muscle contraction, including points of spasm in deeply layered muscle tissue which are not easily reached by other forms of automated and non-automated treatment, wherein a maximum force of approximately one hundred pounds is applied to the excessively contracted muscle fibers at such points of spasm, with greater frequency, uniformity, safety to both patient and therapist, and precision than can be provided manually by therapists with knuckles and hand-held bevel-edged pressure bars to effect a superior result over the manual treatment procedures from which said method has evolved, such applied force releasing acids built up in treated muscle tissue and lengthening muscle fibers, with resulting patient benefit following treatment being immediate pain reduction and increased flexibility, said method comprising the steps of:

providing a probe column assembly having a swivel fitting, a proximal end, a distal end, and a motor with limited torque and a slip clutch as safety features, a plurality of column assembly supports, a current-limiting board, a plurality of sharp bevel-edged treatment probes, a plurality of sensors for measuring direct and sheer forces, computer means having database capability, a plurality of controllers, and a power source;

further providing an X-Y positioning patient support and a plurality of additional sensors that measure muscle conditioning;

selecting one of said treatment probes;

affixing said sensors to said selected treatment probe;

affixing said additional sensors to said probe;

attaching the selected one of said treatment probes to said distal end of said probe column assembly so that said slip clutch will cause said probe to automatically move away from a patient in the event of equipment malfunction or power failure;

manually setting maximum direct and sheer forces at which measurement by said sensors according to encountered muscle hardness will cause said selected treatment probe to automatically retract from a patient;

adjusting said swivel fitting on said probe column assembly so that said swivel fitting has sufficient resistance for probe treatment of muscle tissue through the application of a maximum concentrated force of approximately one hundred pounds;

selecting one of said column assembly supports;

releasably connecting said proximal end of said probe column assembly to the selected one of said column assembly supports for movement in X-axis, Y-axis and Z-axis directions, where said X-axis direction is from the head of a prone patient to the patient's feet and said Y-axis direction is from the left side of the patient to the patient's right side, and where said Z-axis direction is vertical to the ground;

positioning said X-Y positioning patient support beneath a patient beneath a patient whose muscle tissue needs treatment;

coarsely positioning said selected column assembly support in X-axis and Y-axis directions relative to said X-Y positioning patient support;

coarsely positioning said probe column assembly in a Z-axis direction above said X-Y positioning patient support the targeted treatment region on the patient;

optionally positioning said selected treatment probe at an angular orientation relative to said X-Y positioning patient support;

locking said selected treatment probe into said selected angular orientation during treatment with a quick release mechanism on said probe column assembly;

electrically connecting said computer means to said motor for data transfer only;

providing power to said motor by electrically connecting said current-limiting board between said motor and said power source as a safety feature to prevent applied force beyond one hundred pounds in the event of motor malfunction;

electrically connecting said controller to said computer means;

selecting a power source having a maximum electrical current sufficient to engage said motor for application of probe forces in targeted tissue at a maximum of approximately one hundred pounds;

electrically connecting said selected treatment probe, said sensors, and said additional sensors to said selected power source;

moving the table top of said X-Y positioning patient support to finely adjust the X-axis and Y-axis position of the region of the patient requiring treatment to define an easily controlled probe treatment area having a maximum Y-axis dimension of approximately twelve inches and a maximum X-axis dimension also of approximately twelve inches;

using said controller to direct fine Z-axis movement of said probe relative to muscle tissue requiring treatment to define an easily controlled probe treatment area having a maximum Z-axis dimension of approximately six inches;

identifying two bony landmarks on the patient, the identity of the patient, and the position of the patient relative to said probe;

providing such identified patient information to said computer means; and engaging said computer means to provide automated treatment routines with a maximum force application of approximately one hundred pounds to points of spasm in muscle tissue within in said defined treatment area on a patient positioned upon said table top so as to release built-up metabolic by-products in even the most deeply positioned muscle tissue to lengthen it, the maximum force applied by said selected treatment probe being determined according to said manually set maximum direct and sheer forces as measured by said sensors according to encountered muscle hardness as well as measurements of excessive motor current, and also to collect data from said additional sensors for quantitative patient monitoring.

* * * * *